US010948172B2

(12) United States Patent
Lax et al.

(10) Patent No.: US 10,948,172 B2
(45) Date of Patent: Mar. 16, 2021

(54) LED TASK LIGHTING SYSTEM

(71) Applicant: Clear-vu Lighting LLC, Westbury, NY (US)

(72) Inventors: Daniel A. Lax, Roslyn, NY (US); Timothy J. Keuning, Northport, NY (US); Agjah I. Libohova, East Setauket, NY (US)

(73) Assignee: Autronic Plastics, Inc., Central Islip, NY (US)

( * ) Notice: Subject to any disclaimer, the term of this patent is extended or adjusted under 35 U.S.C. 154(b) by 0 days.

(21) Appl. No.: 16/295,241

(22) Filed: Mar. 7, 2019

(65) Prior Publication Data

US 2019/0338935 A1 Nov. 7, 2019

Related U.S. Application Data

(60) Continuation of application No. 14/661,352, filed on Mar. 18, 2015, which is a division of application No. 13/157,115, filed on Jun. 9, 2011, now abandoned.

(60) Provisional application No. 61/353,043, filed on Jun. 9, 2010, provisional application No. 61/372,372, filed on Aug. 10, 2010, provisional application No. 61/391,604, filed on Oct. 9, 2010, provisional (Continued)

(51) Int. Cl.

| | |
|---|---|
| ***F21V 23/06*** | (2006.01) |
| ***F21S 2/00*** | (2016.01) |
| ***H05B 45/00*** | (2020.01) |
| ***F21V 23/00*** | (2015.01) |
| ***F21V 23/02*** | (2006.01) |
| ***F21V 21/116*** | (2006.01) |
| *F21Y 105/10* | (2016.01) |
| *F21Y 115/10* | (2016.01) |

(52) U.S. Cl.

CPC ..... *F21V 23/06* (2013.01); *F21S 2/00* (2013.01); *F21V 23/003* (2013.01); *H05B 45/00* (2020.01); *F21V 21/116* (2013.01); *F21V 23/02* (2013.01); *F21Y 2105/10* (2016.08); *F21Y 2115/10* (2016.08)

(58) Field of Classification Search

None

See application file for complete search history.

(56) References Cited

U.S. PATENT DOCUMENTS 4,183,604 A * 1/1980 Tjornhom, Sr. ..... H01R 33/94 29/764
5,008,595 A * 4/1991 Kazar ..... H05B 45/37 315/178

(Continued)

*Primary Examiner* — Amy Cohen Johnson
*Assistant Examiner* — James H Cho
(74) *Attorney, Agent, or Firm* — Zollinger & Burleson Ltd.

(57) ABSTRACT

The disclosure provides an LED light system that is easy to install and customizable by the user. The LED lighting system may be plugged directly into an existing power source. In one configuration, the system includes a power supply that accepts standard power inputs. A low voltage bus line extends from the power supply. The user may connect LED light modules at essentially any location along a low voltage bus line of the system so that the light modules are located exactly where the user desires light. Uneven spacing is possible. Different size lights, different lumen powers, and different-colored light modules may be disposed along the low voltage bus line. Security features may be used to reduce the value of the system components to a thief.

20 Claims, 21 Drawing Sheets

Related U.S. Application Data application No. 61/438,550, filed on Feb. 1, 2011, provisional application No. 61/486,135, filed on May 13, 2011.

(56) References Cited

U.S. PATENT DOCUMENTS

| | | | | |
|---|---|---|---|---|
| 8,299,719 | B1 * | 10/2012 | Moshirnoroozi | H05B 45/00 315/185 R |
| 2004/0160199 | A1 * | 8/2004 | Morgan | A01M 1/04 315/312 |
| 2007/0257764 | A1 * | 11/2007 | D'Agostino | H01R 13/7137 337/36 |
| 2008/0238340 | A1 * | 10/2008 | Leung | H05B 45/24 315/297 |
| 2010/0328946 | A1 * | 12/2010 | Borkar | F21K 9/233 362/249.02 |
| 2011/0121654 | A1 * | 5/2011 | Recker | H02J 7/0068 307/66 |
| 2011/0134239 | A1 * | 6/2011 | Vadai | F21V 29/773 348/143 |

* cited by examiner

LED TASK LIGHTING SYSTEM

CROSS REFERENCE TO RELATED APPLICATIONS

This application is a continuation application claiming priority to U.S. application Ser. No. 14/661,352 filed Mar. 18, 2015, which is a division of U.S. patent application Ser. No. 13/157,115 filed Jun. 9, 2011, which claims the benefit of each of the following U.S. Provisional Patent applications 61/353,043 filed Jun. 9, 2010; 61/372,372 filed Aug. 10, 2010; 61/391,604 filed Oct. 9, 2010; 61/438,550 filed Feb. 1, 2011; and 61/486,135 filed May 13, 2011; the disclosures of each are incorporated herein by reference.

BACKGROUND

1. Technical Field

The following disclosure generally relates to task lighting systems and, more particularly, to LED-powered, temporary task lighting that may be uniquely configured by the user at the location where the lighting is desired. The disclosure also relates to task lighting systems with security features.

2. Background Information

Numerous applications require temporary task lighting. One such exemplary application is a construction site wherein permanent standard-voltage hard-wired power has not yet been installed. In order to light these sites, the contractor must install temporary lighting. On smaller jobs, temporary lighting results in a bundle of extension cords running through the work area which creates a safety issue. Another issue is that each of the lights must be plugged into an outlet. On larger jobs, the contractor may install temporary hard-wired 110V power at the job site which must be removed after the work is completed. Contractors desire alternative lighting options wherein multiple power outlets are not required and wherein customization of both the size and locations of the light sources is possible. The temporary lighting should also be easy to install and remove. Contractors and customers also desire energy efficiency.

Equipment theft is a problem at construction sites and lighting components would be attractive to a thief if the lighting components could be readily used in other applications. Lighting components can be difficult to secure because they cannot be moved to a secure location within the job site when they are not in use. Contractors thus desire task lighting systems to have features that reduce theft. Some public entities and construction companies specify left hand threaded incandescent light bulbs to reduce the value of the incandescent light bulbs to a thief. Left hand thread incandescent light bulbs cannot be used with typical right hand thread sockets used in homes and offices thus reducing their value to a thief.

Another potential task lighting application is a homeowner's garage, yard, or basement wherein a novice may wish to install lights without the necessity of running hard wires at full voltage.

SUMMARY OF THE DISCLOSURE

The disclosure provides an LED (light-emitting diode) task lighting system that is easy to install, uninstall, and is customizable by the user.

The LED task lighting system includes a power supply that may be connected to a line voltage power source such as a 95, 110, or 220 Volt line source. The power supply is configured to output a low voltage direct current. At least one low voltage bus line is connected to the outlet of the power supply. The user selectively connects LED light modules along the low voltage bus line so that the light modules are located exactly where the user desires light. Uneven spacing of the light modules along the low voltage bus line is possible. Different size lights, different lumen powers, and different-colored LED light modules may be used. The low voltage bus line can be located in a wider variety of locations at the job site than a traditional line voltage power cord. The light modules may be repositioned along the bus line.

One configuration of the LED task lighting system provides self-correcting light modules or self-correcting connector assemblies that allow the user to connect light modules to the low voltage bus line without concern for the polarity of the connection. This configuration of the LED task lighting system provides the self-correcting feature by using a rectifier disposed electrically between the connector and the light module. The rectifier may be a full bridge rectifier. The rectifier may be physically disposed in different locations such as being carried by the connector, being carried by the LED light module, or being carried on the power lead between the light module and the connector.

One version of the system includes a connector that is used to physically and electrically connect a light module power lead to the low voltage bus line. The physical connection provided by the connector assembly reduces strain on the electrical connection. In one configuration, the physical connection is formed with a clamshell clamping action while in another configuration the connection is formed by threaded two elements together about the low voltage bus line. Both configurations of the connector assembly may be locked in a secure condition that requires a specially configured key to be used to disconnect the connector assembly from the low voltage bus line.

One version of the system includes hangers for securing the light modules in place at the location of the lighting. One version of the hanger includes a pair of wire mounting brackets that may be opened, wrapped about a support, and locked in place to secure the light module. Another version of the hanger includes a magnet to hold the light module in place. The magnet may be disposed in a recessed bracket.

In one configuration, the system provides a secondary power supply in addition to the low voltage bus line. The secondary power cord carries a plurality of single or dual power outlets so that workers have ready access to line voltage power in convenient locations. At least one of the power outlets may include a ground fault circuit interrupter feature. This outlet may be the first outlet that is closest to the power supply for the secondary power supply.

The system may include a power supply that supports multiple low voltage bus lines and secondary power cords that can be strung in different locations from the power supply.

The system may be changed to a low power mode to reduce power consumption. The system may be changed to its low power mode directly from the power supply or from a location remote from the power supply. The power supply may include a timer that allows the user to set the times for the low power modes. The power supply also may be configured to receive a low power mode signal from a remote source via a signal through a low voltage control line, a wireless signal, or an instruction delivered over a computer network. When a plurality of systems are in use on a large project, all of the systems may be turned to their low power modes with a common command in order to reduce power consumption.

Another configuration of the system provides a low voltage bus line that supports a plurality of threaded sockets that accept threaded LED modules. The threaded connection between the LED module and the socket ensures the correct polarity of the connection between the power cord and the module. In this configuration, a rectifier is not needed because the threaded connections guarantee the polarity of the connection between the LED light module and the low voltage bus line.

Another configuration of the system provides a LED light module having a left hand thread that is received in a left hand thread socket connected to the low voltage bus line. The use of the left hand thread with the LED module reduces the resale value of the LED module and thus reduces the likelihood that it will be stolen.

Alternatively, the system provides a left hand threaded LED light module that itself includes an AC to DC transformer so that the left hand threaded LED light module may be used with a standard left hand socket electrically connected to standard alternating current line power.

Another configuration of the system provides a low voltage bus line that carries a plurality of spaced sockets that receive LED light modules. The sockets may be configured to receive the LED light modules with a threaded connection. The thread on the LED light module may be a right hand or a left hand thread. In one configuration, the LED light modules are simply standard LED bulbs without drivers or transformers. The stringer is used with a power supply that provides the low voltage DC power to the low voltage bus line and the threaded connections between the light modules and the sockets ensure the correct polarity. This configuration allows the power supply to be located is a secure location while the LED modules disposed in theft-vulnerable locations are low-value objects. In alternative configuration, the low voltage bus line is standard line voltage with each of the LED light modules including an AC to DC transformer that supplies the desired voltage to the LED light module. In this configuration, left hand thread is desirable to reduce theft value.

One configuration of the system also inhibits theft by making its individual components less valuable for resale and allowing some components to be located in a secure location. The power supply may be disposed in a secure location.

Another configuration of the system includes a power supply that transmits a security signal that must be received by the individual light modules or the connectors for the light module before the light module will turn on. The security signal may be a carrier signal transmitted at a specific frequency that, when sensed by a component at the connector or light module, activates the light module. In one configuration, the component closes a switch to allow current to flow to the light module. The signal may be transmitted in the low voltage bus line, through the air as a radio frequency, or through a separate control line. When the security signal is not sensed, the switch remains open and the light module is not powered. The delivery of the power to the light module may be controlled by a microprocessor, a microchip, a switch, or a relay that receives the security signal and determines if the security signal is the authorized security signal based on its preprogrammed instructions or configuration. When the wireless configuration is used, the security signal may be a radio frequency signal transmitted at a predetermined frequency or in a predetermined pattern such that the receiver will power the light module upon sensing the signal. In another configuration, a wireless security feature may follow the security protocols used to secure a WIFI network.

BRIEF DESCRIPTION OF THE DRAWINGS

Similar numbers refer to similar parts throughout the specification.

DETAILED DESCRIPTION OF THE DISCLOSURE

Figure 1:
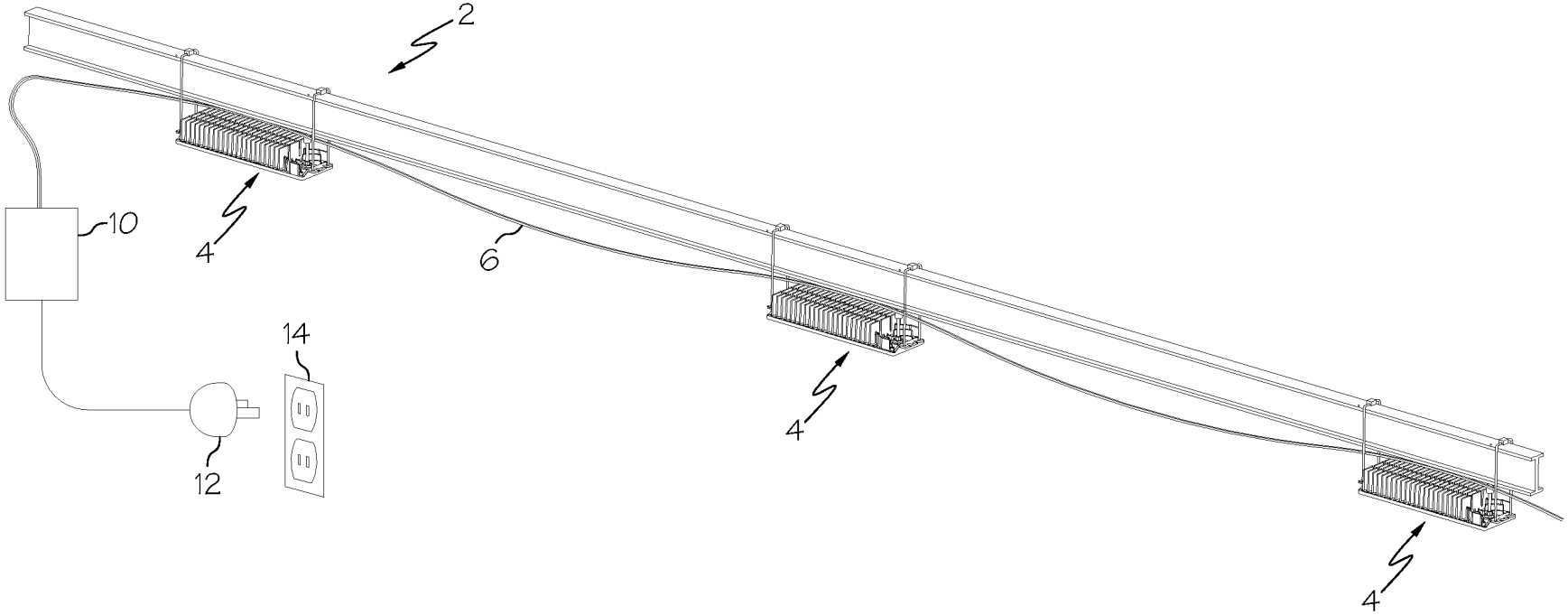
FIG. 1 is view of an exemplary installation of the LED lighting system with portions of the system shown schematically.
Figure 2:
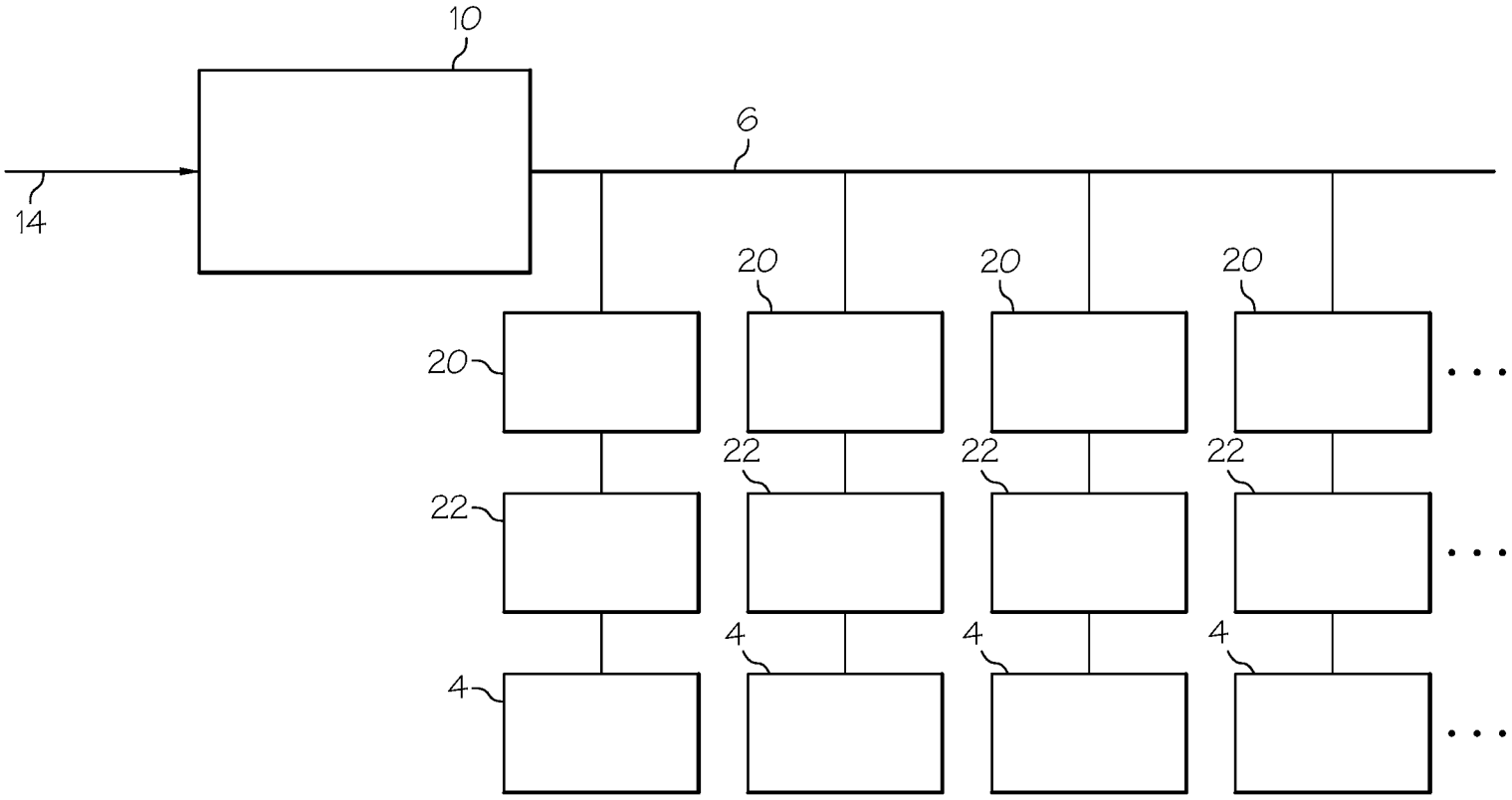
FIG. 2 is an electrical schematic of the system.

An exemplary configuration of the lighting system is indicated generally by the numeral 2 in the accompanying drawings. Lighting system 2 may be temporarily installed at locations such as construction sites and industrial operating environments to provide general and task lighting. System 2 uses light emitting diode (LED) light sources powered low voltage direct current to safely and conveniently provide suitable task lighting. System 2 also may be temporarily or permanently installed in locations such as a basement or a garage workshop to provide task lighting. System 2 allows the user to connect light modules 4 anywhere along a low voltage bus line 6 to customize the number of light modules 4 and the locations of the light modules 4 of system 2. System 2 also allows the user to select the type of light module 4 used at different locations. For example, the user may install large and small light modules 4, different color light modules 4, light modules 4 having different shapes, or light modules 4 of differing lumen output at the different locations along low voltage bus line 6. LED light modules may be provided with high-output LED light engines that output about 800 lumens to 6500 lumens and are suitable for task lighting. A 2000 lumen light module 4 may be used. Light modules 4 may be unevenly spaced along low voltage bus line 6 as desired. The user may customize each installation as needed. System 2 may be reconfigured after initially set up and installed because each light module 4 may be disconnected and reconnected to low voltage bus line 6 at different locations. System 2 may be reused and reconfigured at a later time.

Lighting system 2 generally includes a power supply 10 that transforms the alternating current from commonly available electrical power sources (such as 95V or 110V or 220V line voltage) to a low voltage direct current power supply available in low voltage bus line 6 (such as a 12V, 24V or 48V direct current supply). Power supply 10 may include a plug 12 that allows system 2 to be plugged into a standard alternating current line power source 14. System 2 may be configured to function with a range of input line power voltages such as from 90V to 277V and to accommodate power surges. In the exemplary configuration, power supply 10 outputs a 22V to 28V to low voltage bus line 6. Power supply 10 may support multiple independent low voltage bus lines 6 such that cords 6 may extend in different directions from power supply 10. Power supply 10 may be a 450 W supply with a 90-265 VAC input with an output of 24 VDC (22-28 VDC) that may be used to energize up to sixteen modules 4 on a single low voltage bus line 6. Low voltage bus line 6 may be provided in relatively long lengths (over 100 feet in length) so that it may be strung about the work area to be lit. Up to 300 feet of 10 gauge wire may be used. The low voltage of low voltage bus line 6 allows main low voltage bus line 6 to be installed and located in manners that would not be suitable for full 110V power lines. The use of the 24V low voltage bus line 6 also speeds the installation of system 2.

Each light module 4 is connected to low voltage bus line 6 with a connector 20 that forms an electrical connection with low voltage bus line 6. Connector 20 may be configured to form the electrical connection with low voltage bus line 6 without the use of tools such that the user may simply snap, press, thread, or clamp connector 20 onto low voltage bus line 6 at a desired location. A T-splice connector may be used. Connector 20 may include teeth or leads that cut through the insulation of low voltage bus line 6 to form the electrical connection. In other configurations, connector 20 may require areas of low voltage bus line 6 to be stripped to expose the conductor. In further configurations, connector 20 may be in the form of a junction box or socket that allows a connection to be readily formed. Connector 20 may be carried by a connector assembly 120 that engages low voltage bus line 6 to prevent the electrical connection between the low voltage bus line 6 and connector 20 from being strained.

In contrast to typical lighting fixtures powered by alternating current, LEDs are polarity sensitive. In typical LED fixtures configured to be connected to alternating current line voltage, an integrated driver or integrated power supply converts the power and handles the polarity issue. System 2 is configured to allow the user to install light modules 4 directly to low voltage bus line 6 and the users will not always form the electrical connection with the correct polarity. As such, a rectifier 22 is disposed electrically between each connector 20 and each light module 4 to ensure that the polarity of the power being delivered to each light module 4 is correct. A full bridge rectifier or other suitable rectifiers may be used. Rectifier 22 allows the user to install connector 20 without regard for the polarity of low voltage bus line 6. This is especially beneficial when connectors are simply snapped into place by the user. Rectifier 22 is used with each module 4 in that the electrical connection of module 4 with low voltage bus line 6 is not controlled. System 2 is thus self-correcting and easy to install. Rectifier 22 may be disposed in the same housing as connector 20.

An alternative configuration of system 2 does not use rectifier 22. Instead, system 2 uses a connector 20 that either provides an indicator showing the correct polarity or a connector 20 that includes feature making it difficult to install with reversed polarity. In the first example, connector 20 may be a T-splice that is color coded to cooperate with a color coded low voltage bus line 6 so that the user will correctly make the positive and negative connections. Connector 20 may have portions colored red and black that correspond to the red and black wires of low voltage bus line 6. In this configuration, the user must correctly orient connector 20 with respect to low voltage bus line 6 in order to provide the correct polarity to module 4. In the second example, the connector may be configured to only connect to low voltage bus line 6 in the correct polarity such as by using different-sized or different-shaped positive and negative wires.

Each light module 4 may be one or a plurality of light emitting diodes (LEDs) or one or a plurality of LED engines of essentially any lumen strength, color, or configuration suitable for task lighting. Each module 4 should output over 800 lumens. Individual or groups of LEDs may be covered by a protective cover that protects the LEDs from damage or by a combination lens and protective cover that enhances the light distribution from the LEDs.

In one optional configuration, each light module 4 will not turn on without first receiving or sensing a security signal. The security signal may be provided by power supply 10 through low voltage bus line 6 or transmitted through the air. An alternative configuration uses a control line separate from low voltage bus line 6 to provide the security signal to the light modules. The security signal also may be provided by a security component separate from power supply 10 such as a radio frequency transmitter, WIFI transmitter, or a frequency generator electrically connected to low voltage bus line 6. A security signal receiver is carried by light module 4 or connector assembly 120 to provide the security feature. When the receiver is configured to sense a specific carrier signal in the low voltage bus line, the receiver is positioned electrically upstream of rectifier 22 so that the security signal is not compromised by rectifier 22. Also, the receiver may be positioned after rectifier 22 and is configured to recognize the rectified security signal. The receiver is configured to provide electrical current to light module 4 after the security signal is sensed or only when the security signal is present. For example, the security signal may be provided as a carrier signal in low voltage bus line 6 at a predefined frequency that is not normally output by power supply 10. Such a carrier signal may be generated at a particular frequency by a signal generator—such as a clock carried by power supply 10. The security signal receiver may be a microprocessor configured to provide electrical current to light module 4 only when the predetermined signal frequency is detected in the low voltage bus line 6. The security signal receiver may be a microprocessor, microchip, a smart-switch, or a controller that opens or closes a relay or switch to provide the current to light module 4 when the correct signal is present. The signal may be fixed, randomly changed from time to time, or manually changeable by the user. In addition, the security signal does not have to be present at all times. It may be provided in intervals or in patterns. The interval or pattern of the signal also may be part of the security signal. In this example, the light modules will only turn on when connected to low voltage bus line 6 that carries the security signal from power source 10. Power source 10 may be located in a secure location that discourages theft. The security signal also may be provided through the air in the form of a radio frequency transmission that is received by the security signal receiver. The security signal may be a signal of a predetermined frequency, a pattern of transmissions, a code number, or a combination of signal configurations. WIFI security protocol such as WEP or WPA may be used. These security features reduce the theft value of light modules by rendering light modules 4 unusable with standard power supplies unless the thief bypasses the security features with new wiring. These security features may be applied to other lighting systems that are vulnerable to theft. Examples include the systems of FIGS. 16 and 17 described below. For example, a temporary lighting system that uses a line voltage bus line to support a plurality of light modules may use the security features to prevent the modules from operating and thus greatly reducing the value of the lighting modules to a thief.

Figure 3:
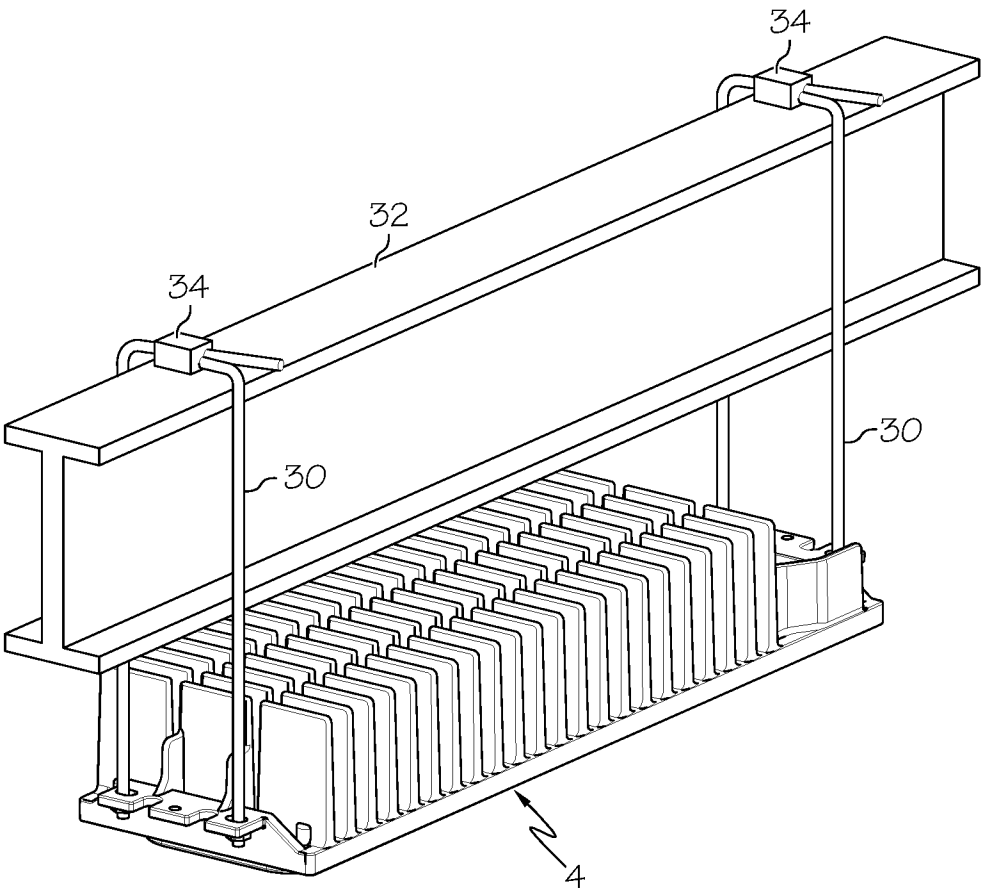
FIG. 3 is a top perspective view of a first exemplary hanger for an exemplary light module.
Figure 4:
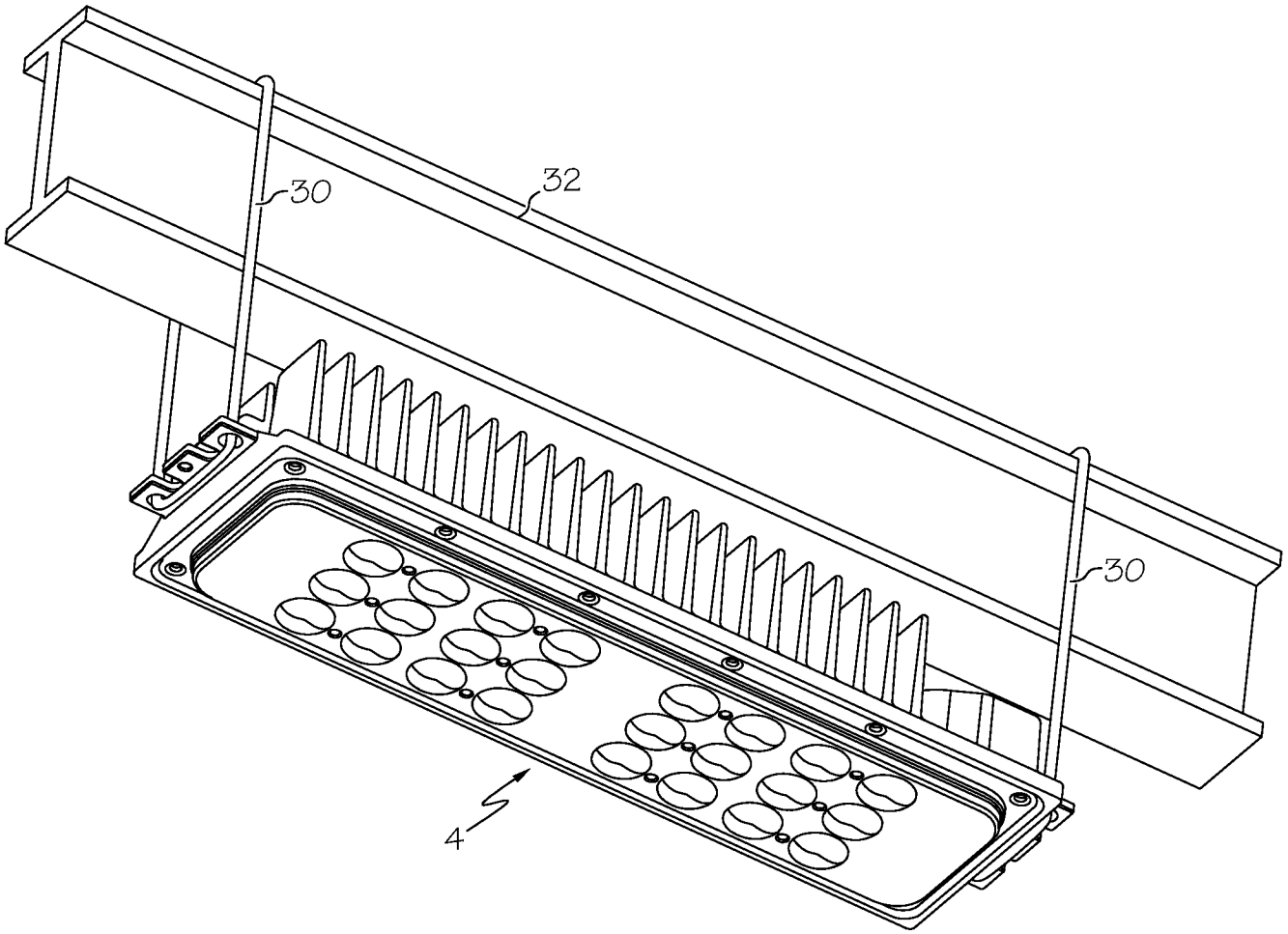
FIG. 4 is a bottom perspective view of FIG. 3.

FIGS. 3 and 4 depict a first exemplary configuration for a hanger 30 that may be used to secure light module 4 to a structure 32 such as the I-beam depicted in the drawings. In this configuration, hanger 30 is a wire that is fished through openings defined by the housing of module 4. The two ends of the wire are brought together and locked in place with a lock 34.

Figure 5:
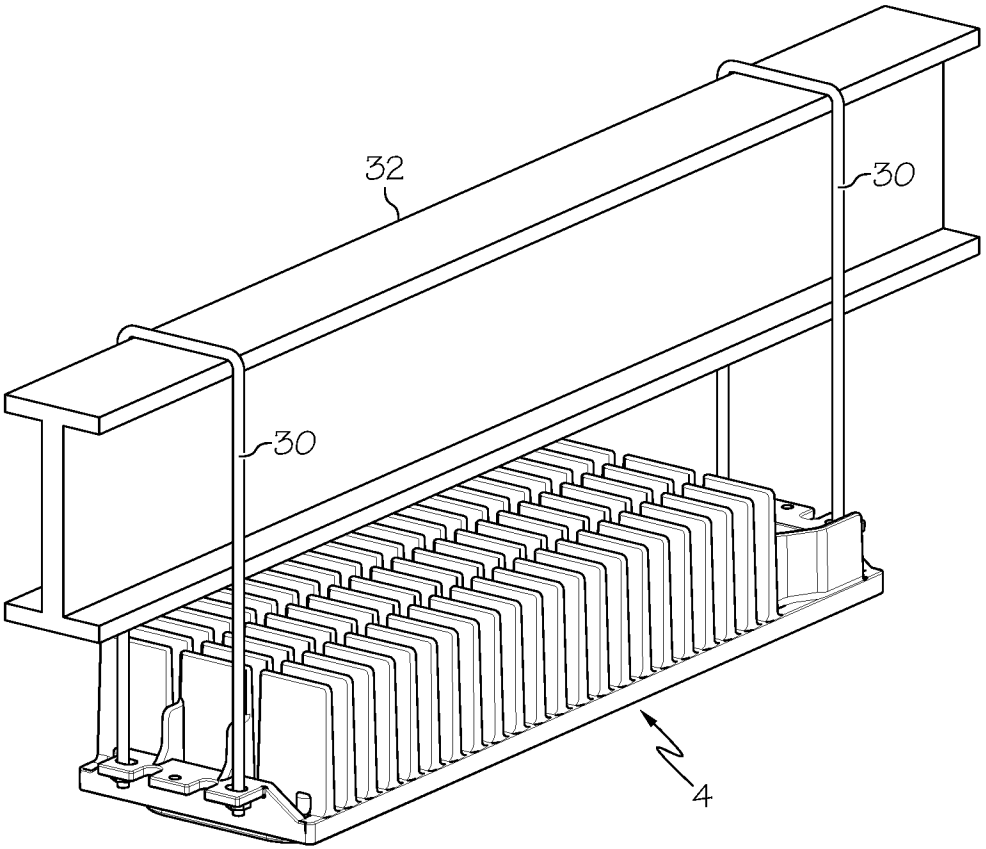
FIG. 5 is a top perspective view of a second exemplary hanger for an exemplary light module.
Figure 6:
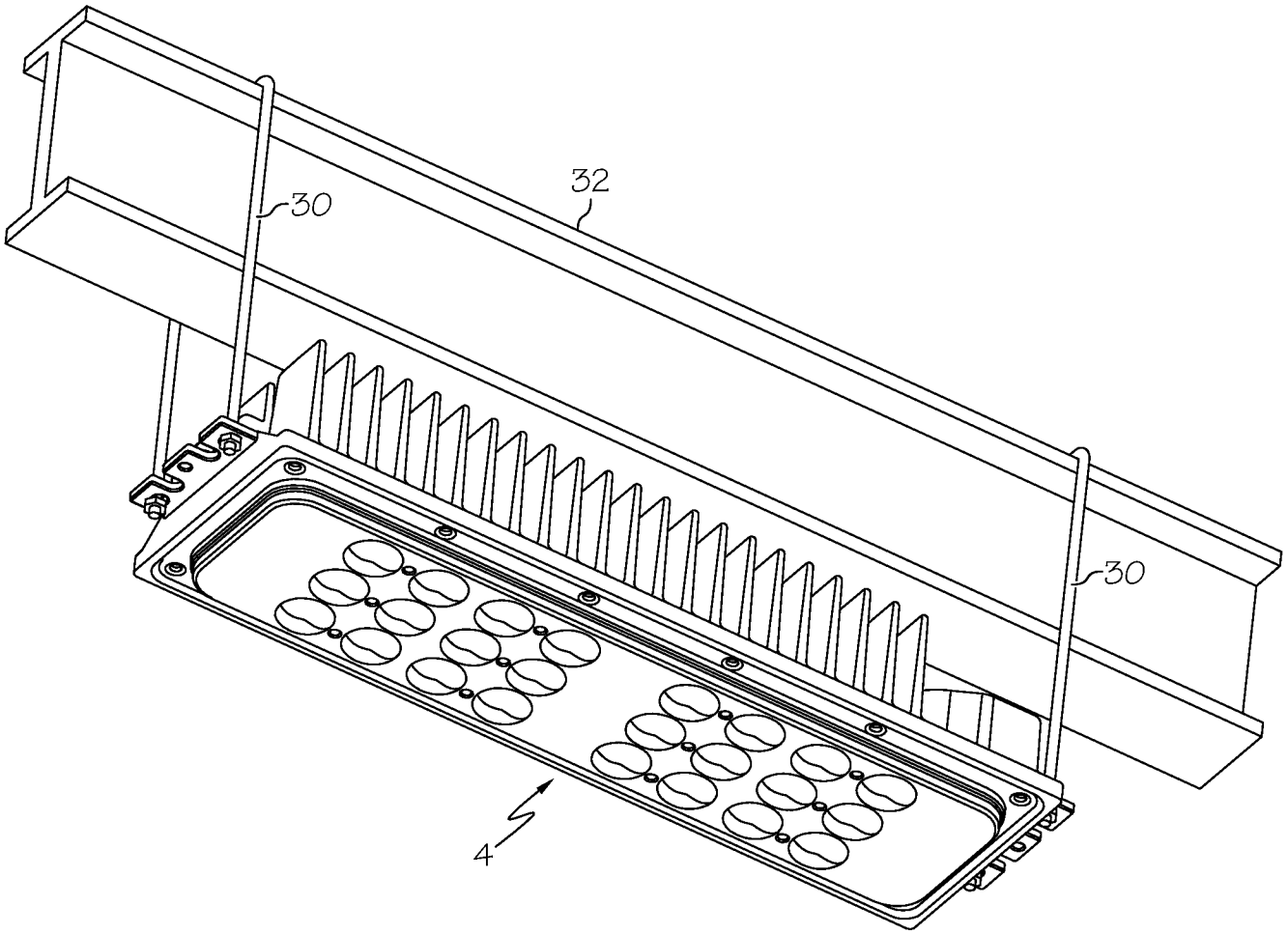
FIG. 6 is a bottom perspective view of FIG. 5.

FIGS. 5 and 6 depict a second exemplary configuration for a hanger 30 in the form of a U-shaped structure (such as a U bolt) having two parallel, spaced threaded ends that extend through openings defined by the housing of module 4. Nuts are threaded onto the ends to prevent module 4 from falling off of the U-shaped structure.

Figure 7:
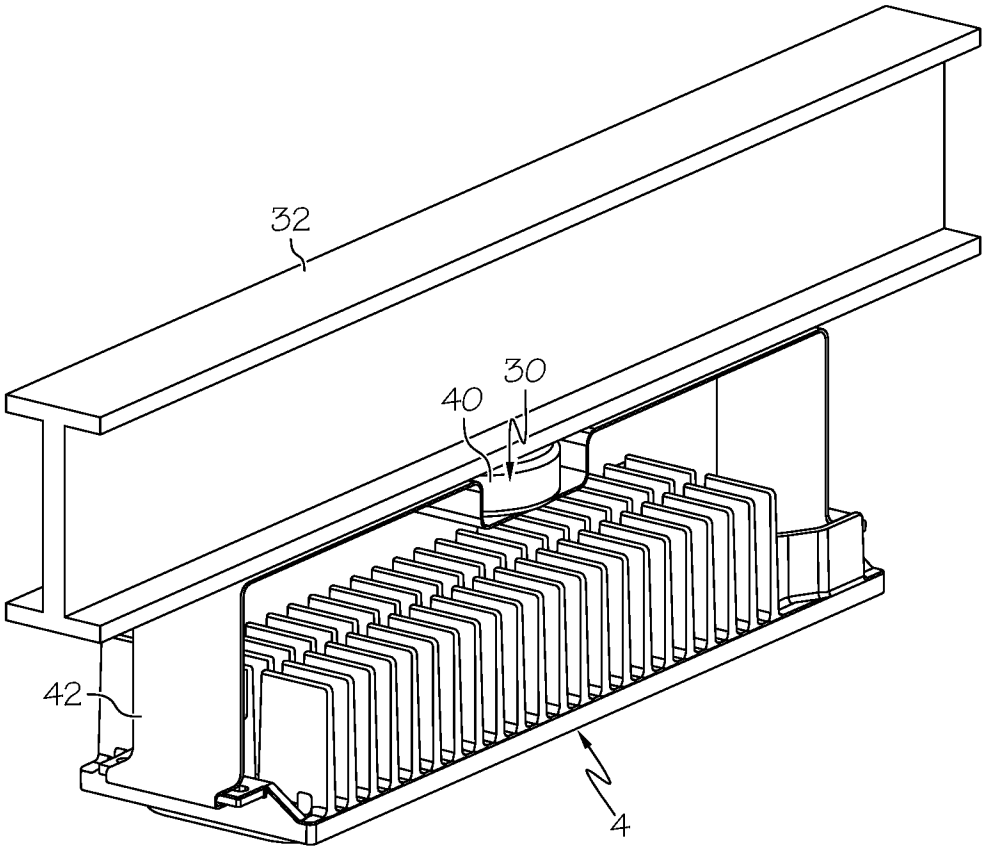
FIG. 7 is a top perspective view of a third exemplary hanger for an exemplary light module.
Figure 8:
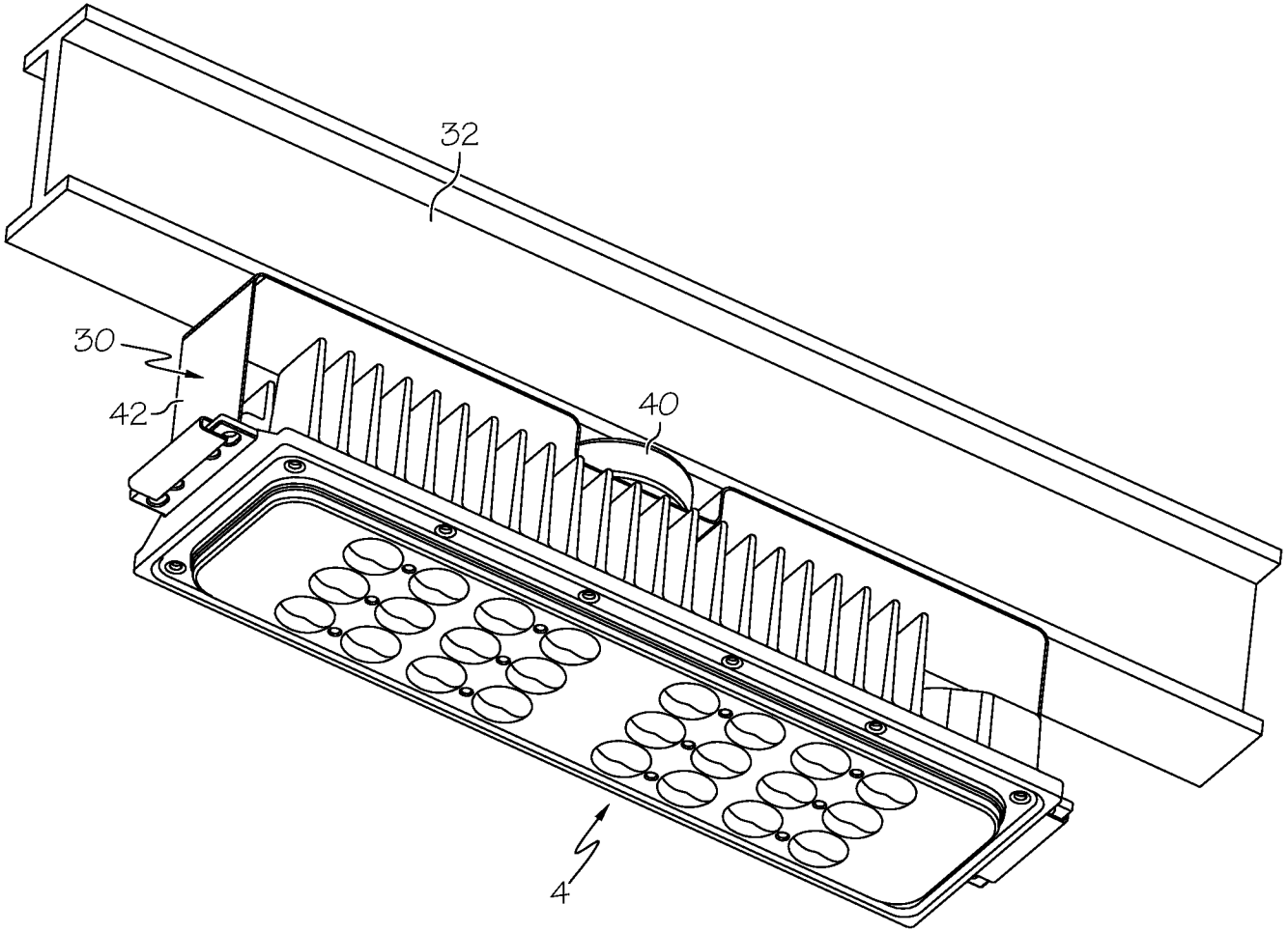
FIG. 8 is a bottom perspective view of FIG. 7.

FIGS. 7 and 8 depict a third exemplary hanger configuration while includes a magnet 40 and a bracket 42. Bracket 42 is secured to the housing of module 4. Bracket 42 includes at least one portion that is attractable to a magnetic field such that magnet 40 may be used to secure bracket 42 and module 4 to another metal structure. Bracket 42 may be designed with a recess sized to receive magnet 40.

An alternate configuration for the housing of module 4 includes a rugged plastic or metal protective body that substantially surrounds the LED assembly. The housing defines a plurality of U-shaped structures on its rear wall that define openings or recesses. In this configuration, hooks or loops may be used to secure module 4 to hangers 30.

Figure 9:
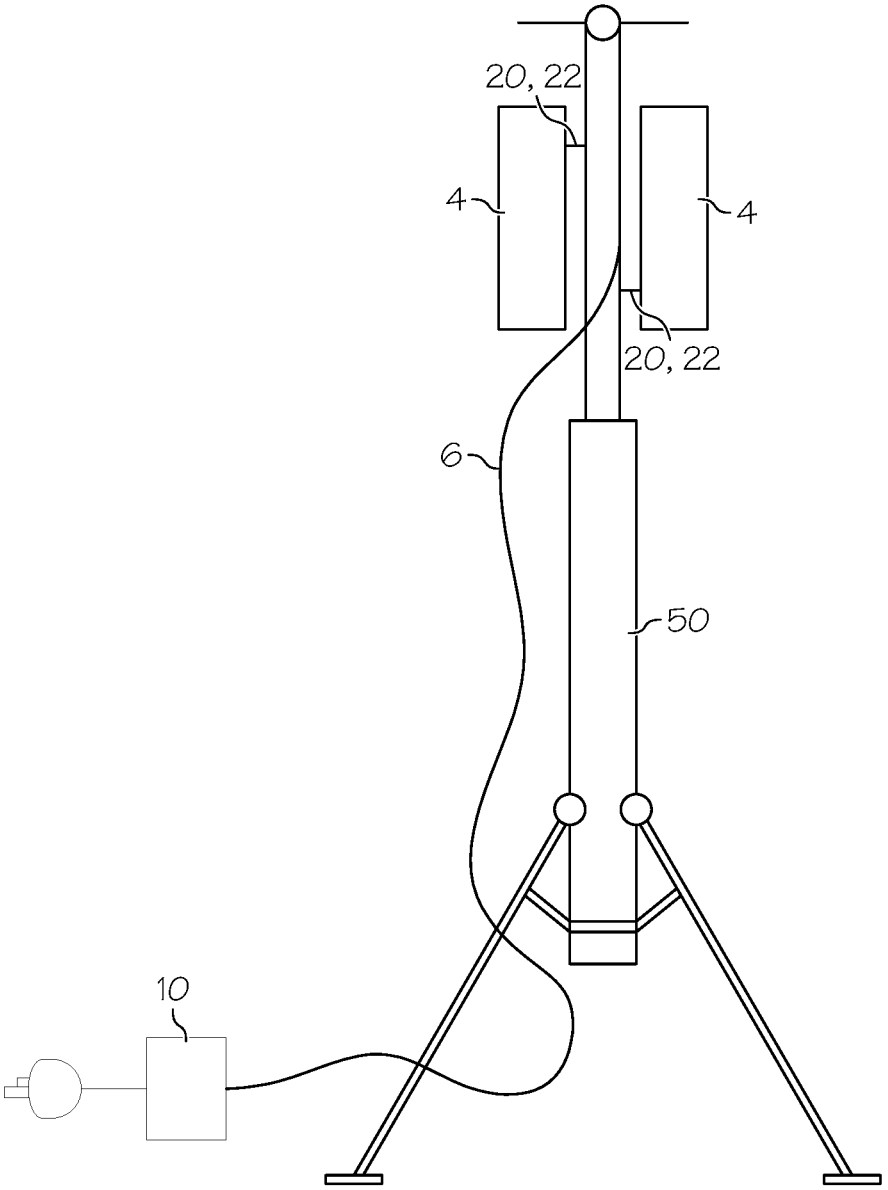
FIG. 9 is a schematic view of the lighting system used with a floor stand.

FIG. 9 depicts a configuration wherein modules 4 are carried by a floor stand 50 to provide the task lighting. Floor stand 50 may be a tripod.

Figure 10:
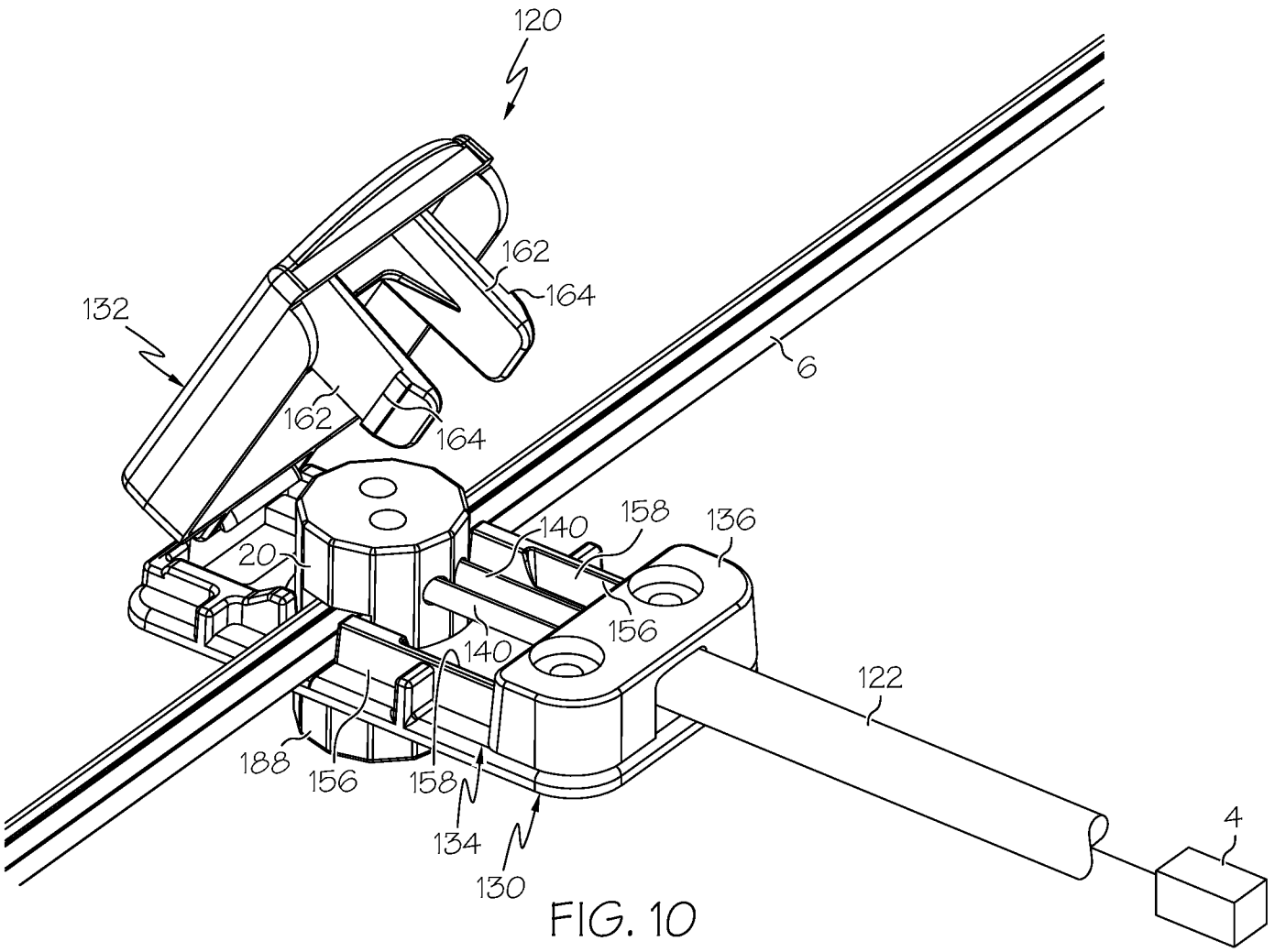
FIG. 10 is a top perspective view of an exemplary connector assembly in an open position after the electrical connection between the low voltage bus line and light module cord has been made.
Figure 11:
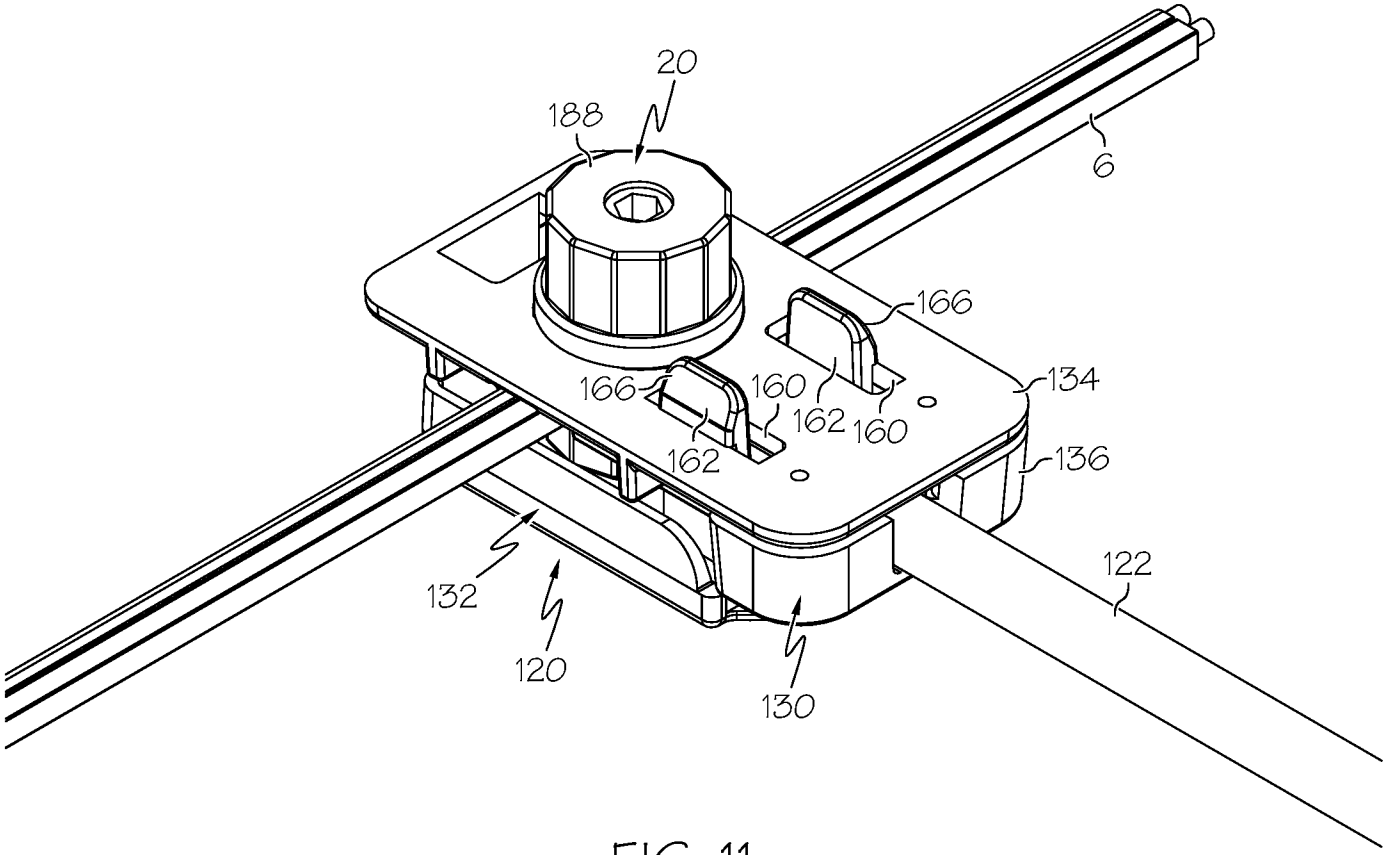
FIG. 11 is a bottom perspective view of the connector assembly from FIG. 10 in a closed condition.
Figure 12:
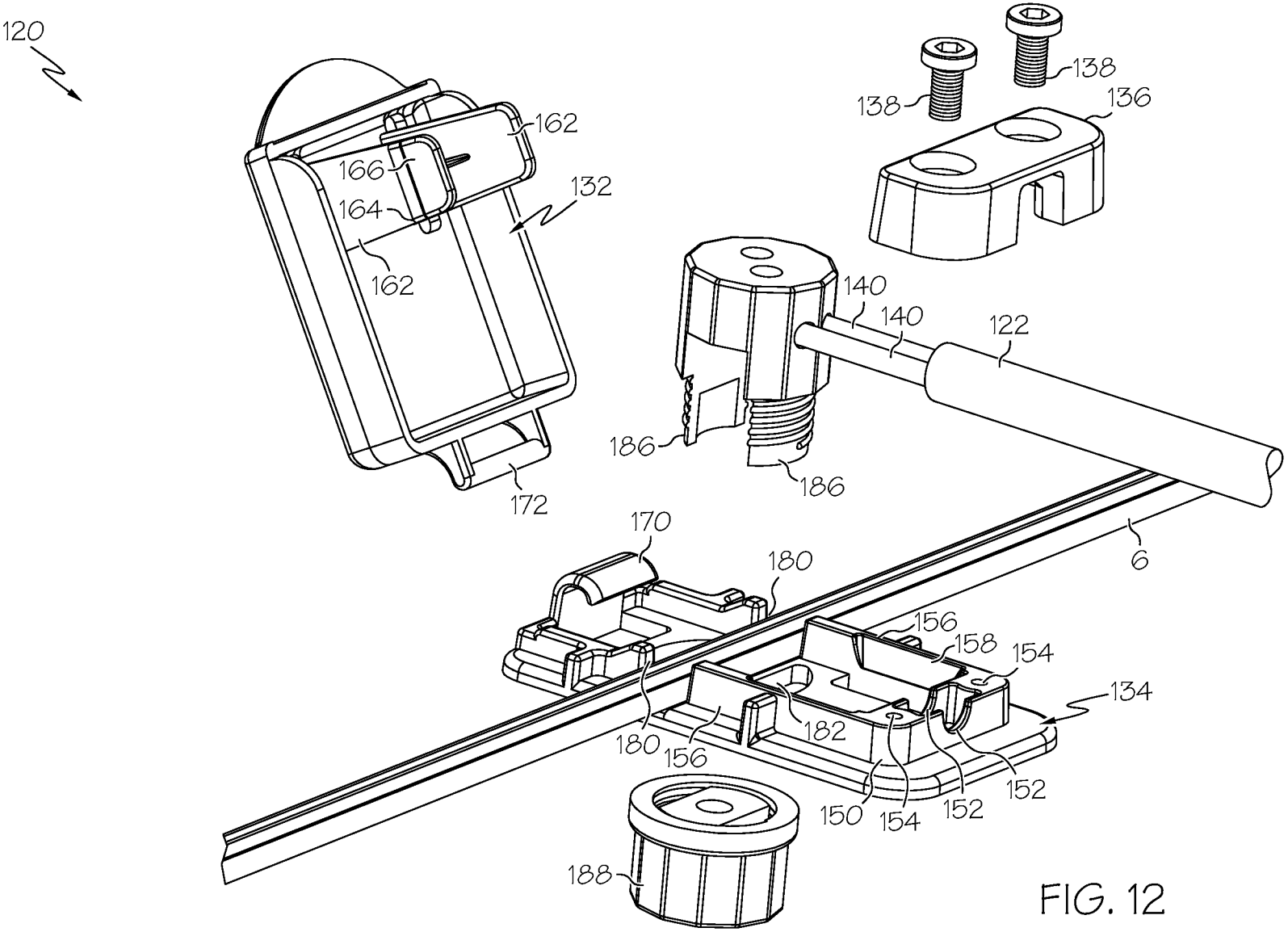
FIG. 12 is an exploded perspective view of the connector assembly of FIGS. 10 and 11.

FIGS. 10-12 depict a non-limiting example of a connector assembly 120 that provides an electrical and physical connection between low voltage bus line 6 and a power lead 122 that supplies electricity to light module 4. The physical connection is used to reduce or eliminate strain on the electrical connection between module 4 and low voltage bus line 6. Connector assembly 120 provides a protective housing for connector 20 and a physical connection between power lead 122 and low voltage bus line 6 so that connector 20 and the electrical connection between lead 122 and low voltage bus line 6 are protected from strain and other forces which may be imparted to power lead 122 or low voltage bus line 6. As described above, connector 20 may carry rectifier 22 and thus rectifier 22 also may be physically protected by connector assembly 120.

In one configuration, connector assembly 120 generally includes a base 130 and a cover 132 that is movable between open and closed positions with respect to base 130. When assembly 120 is positioned over low voltage bus line 6 and cover 132 is closed, line 6 is securely clamped between base 130 and cover 132.

Base 130 generally includes a base plate 134 and a wire clamp 136. In this configuration, wire clamp 136 is connected to base plate 134 with connectors 138 (FIG. 12) that provide a clamping force between clamp 136 and plate 134 so that power lead 122 may be clamped to base 130 such that forces imparted to power lead 122 are transferred to base 130 thus protecting the electrical connection between lead 122 and line 6. Connectors may be screws, bolts, or releasable snap fit connectors that ratchet into place. The lead wires 140 of power lead 122 may be provide with some slack within base 130. Base 130 defines a boss 150 that defines a recessed seat 152 that receives power lead 122. Boss 150 defines openings 154 that receive connectors 138 on either side of power lead 122. Boss 150 also defines sidewalls 156 that cooperate with cover 132 to define compartment for the end of power lead 122.

Within the compartment for power lead 122, base plate 134 defines a pair of latch openings 160 that each receives a resilient latch finger 162 that projects from cover 132. Each latch finger 162 defines latch surface 164 that snap fits to a corresponding latch surface defined by base 132 to latch cover 132 in the closed position and as shown in FIG. 11. Sidewalls 156 also define angled recesses 158 that may be used to move fingers 162 as cover 132 is closed. The end 166 of each finger 162 may be angled to facilitate the engagement and movement of fingers 162. Fingers 162 are configured to cooperate with the thickness of line 6 so that a clamping force is created against line 6 when fingers 162 are latched.

Cover 132 is hinged to base plate 134 so that it may pivot between the open and closed positions. In the exemplary configuration, base plate 134 defines a hook 170 that receives a bar 172 to form the hinge. These pieces may be reversed in other configurations of assembly 120.

Sidewalls 156 define seats 180 for low voltage bus line 6. Seats 180 are aligned with a cord support 182 that supports low voltage bus line 6 when connector 20 is installed. On opposite sides of support 182, base plate 134 defines openings 184 that receive the threaded legs 186 of connector 20 to allow these legs 186 to project through base plate 134 where the nut 188 of connector 20 may engage legs 186 and secure connector 20 in place. Nut 188 is tightened to create the electrical splice in connector 20.

In order to connect a light module 4 with low voltage bus line 6, the end user positions base 130 on a portion of low voltage bus line 6 so that low voltage bus line 6 is disposed on support 182 with its electrical lines disposed side by side as shown in FIG. 10. The user then pushes the top of connector 20 down against low voltage bus line 6 and installs nut 188 to form the electrical connection between low voltage bus line 6 and power lead 122. Cover 132 is closed and latched to clamp assembly 120 to line 6 such that the electrical connection is protected.

Figure 13:
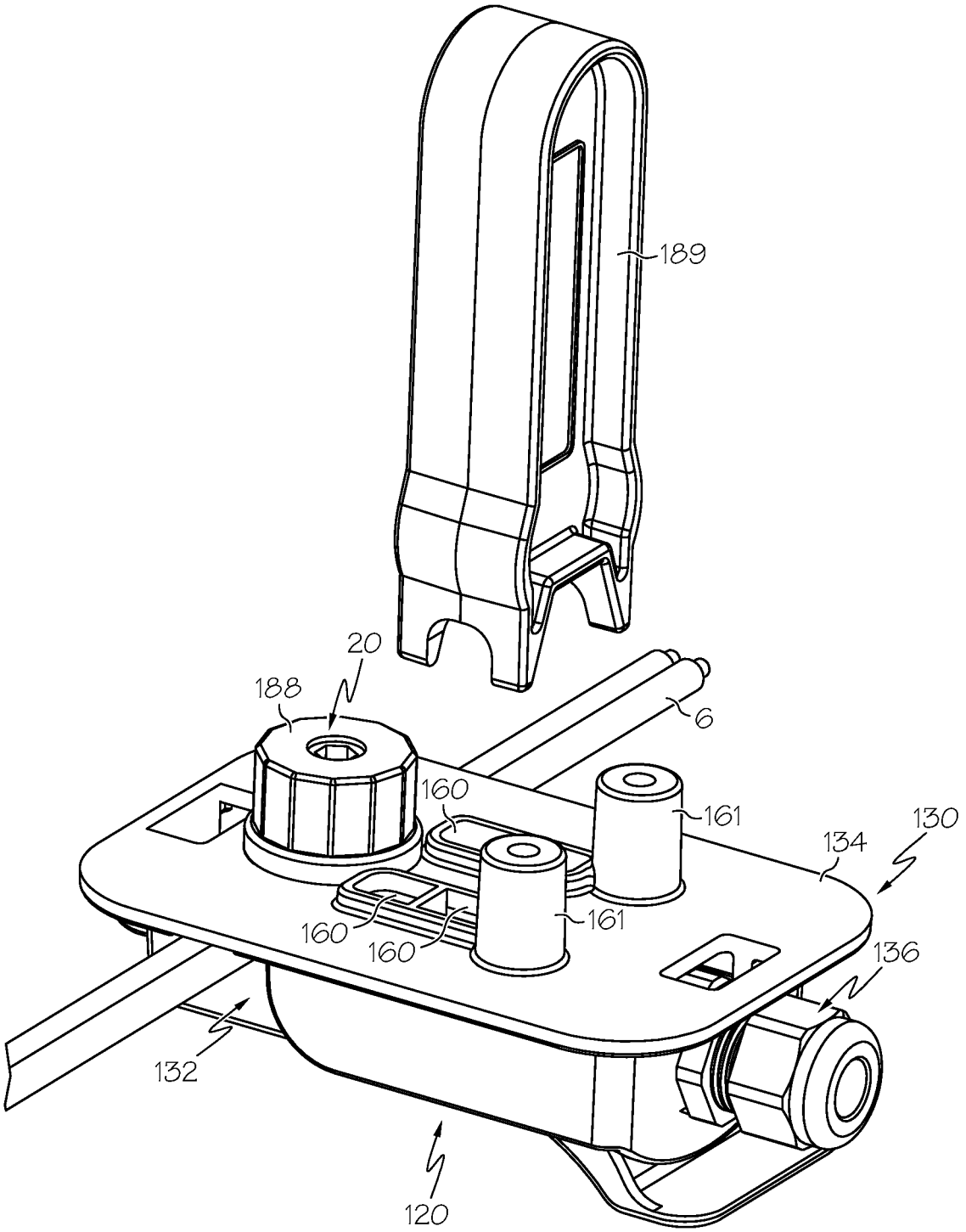
FIG. 13 is a bottom perspective view of another connector assembly configuration that requires a specially configured key to unlock the assembly before it may be opened.
Figure 14A:
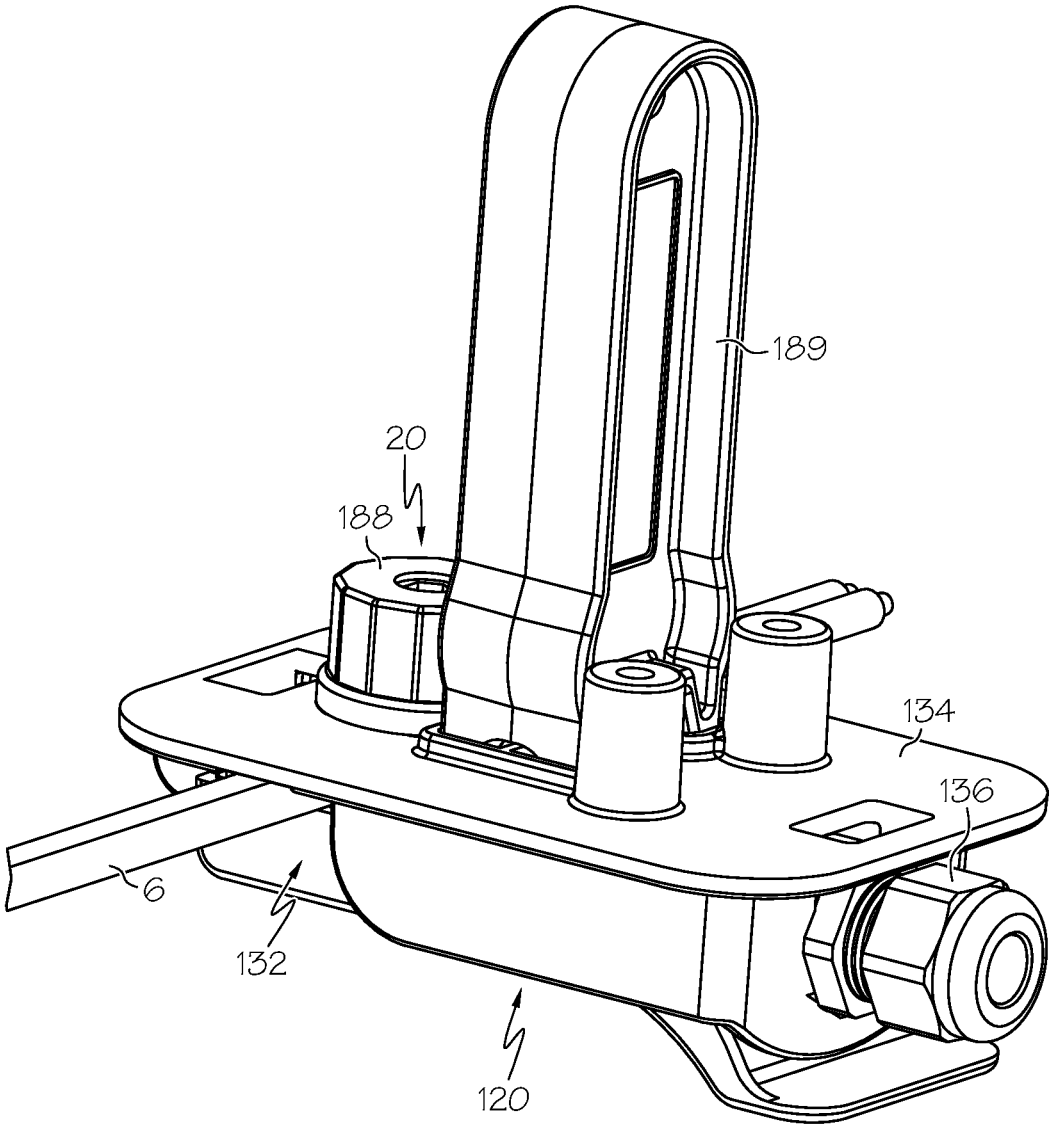
FIGS. 14A and B show how the key is used to unlock the connector assembly.

FIGS. 13-14 depict an alternative configuration of connector assembly 120 wherein latch fingers 162 are recessed below base plate 134 when connector assembly 120 is latched as shown in FIG. 13. With fingers 162 recessed, a specially configured key 189 must be used to open connector assembly 120. This configuration of connector assembly 120 thus includes a security feature that inhibits theft of system 2. This configuration of connector 20 also discourages unauthorized workers from adding repositioning lights without access to key 189.

In the exemplary configuration, cover 132 of connector assembly 20 includes four spaced latch fingers 162 that engage base 130 with a snap-fit connection. All four of these spaced latch fingers 162 must be moved to their unlatched positions simultaneously in order to open cover 132. This is achieved by inserting key 189 into openings 160 from the rear of connector 20 to engage and move ends 166 of fingers 162. In this configuration, four separate and spaced openings 160 are provided and raised perimeter ridges are disposed around openings 160.

Figure 14B:
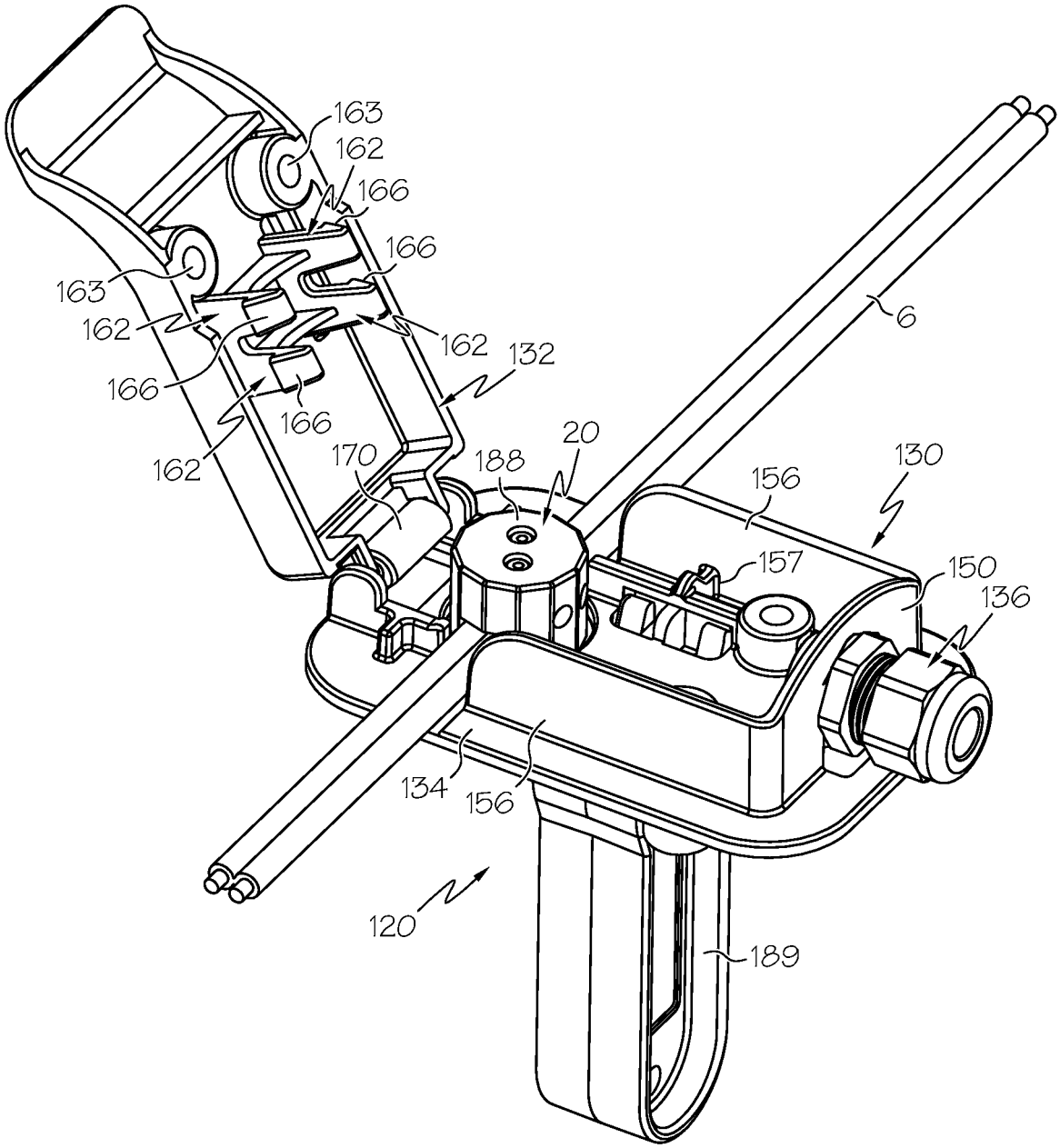

In the configuration of FIGS. 13-14, wire clamp 136 is in the form of a threaded wire clamp disposed in an opening defined by boss 150. Wire clamp 136 engages power lead 122 and transfers pulling forces imparted to power lead 122 to base 130 and not connector 20. Wire clamp 136 and power lead 122 may be configured to support the weight of light module 4. Low voltage bus line 6 is clamped between the sidewalls of cover 132 and base plate 134. In this configuration, the sidewalls of cover 132 are disposed inwardly of walls 156 of base 130 and may be seated on guides 157 (shown in FIG. 14B) disposed inwardly of walls 156 that properly position cover 132 and prevent low voltage bus line 6 from being crushed. Gaskets or seals may be used to seal connector 20 to make connector assembly 120 water resistant.

Connector assembly 120 may be mounted to a surface so that it may be used to support line 6 at the work site. To facilitate the mounting, base 130 supports a pair of mounting feet 161 that are disposed at least as high as the end surface of nut 188. Feet 161 and nut 188 may be used to support assembly 120 flush against the mounting surface. Fasteners are passed through feet 161 to mount base 130 to a surface such as a wall. The fasteners also may pass through cover 132 at bosses 163 such that cover 132 is held closed by the fasteners in addition to fingers 162.

In the configurations described above, fingers 162 project from cover 132. The arrangement of fingers 162 and openings 160 may be switched such that fingers 162 project from base 130. In other configurations, fingers 162 carried a metal element that may be used to pivot fingers 162 from their latched position to their unlatched position with magnetic force.

Figure 18:
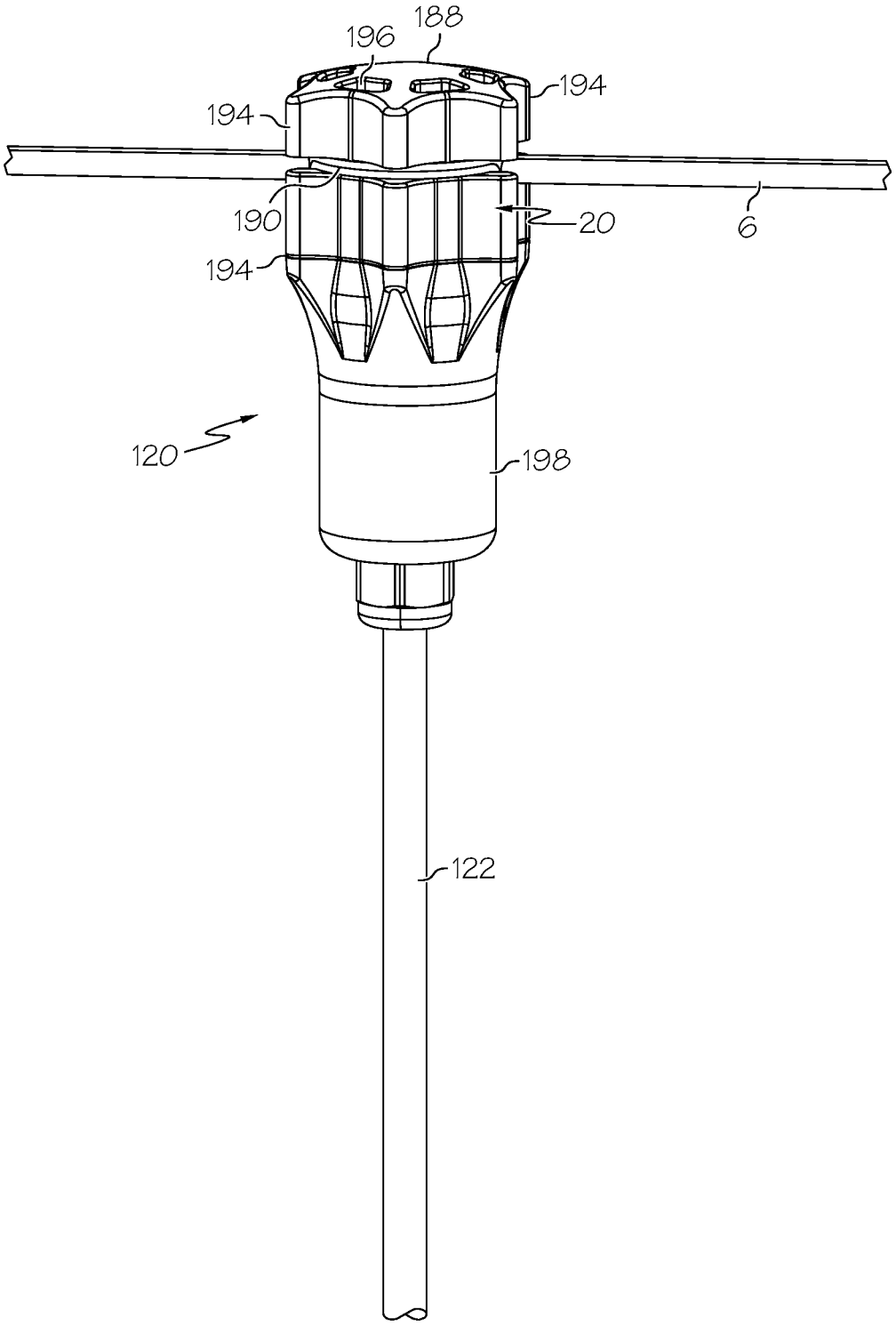
FIG. 18 is a top perspective view of an exemplary connector assembly in a closed position after the electrical connection between the low voltage bus line and light module cord has been made.
Figure 19:
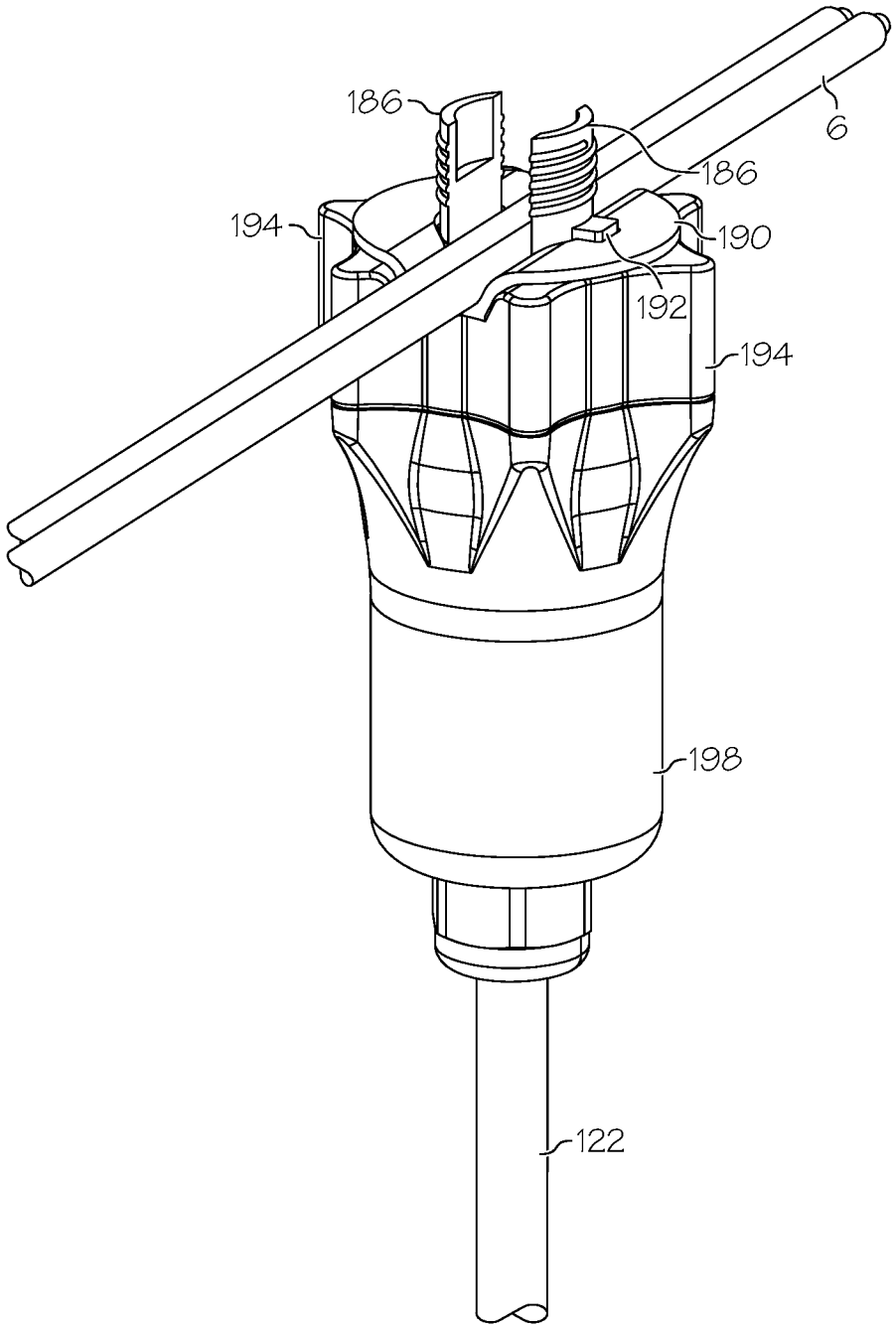
FIG. 19 is a view similar to FIG. 18 but having the nut removed to show the low voltage bus line positioned in the seat of the connector.
Figure 20:
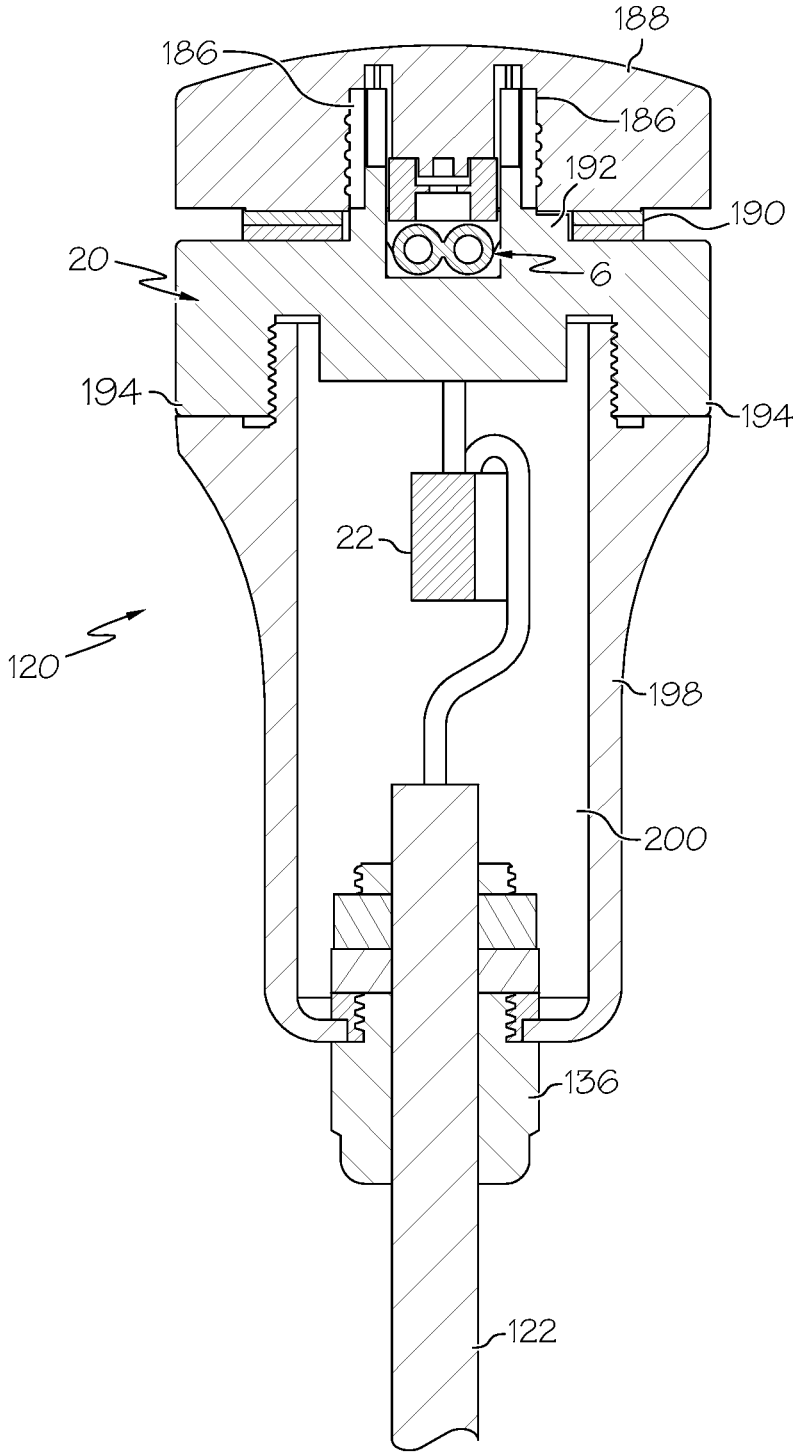
FIG. 20 is a section view taken through the connector of FIG. 18.

FIGS. 18-20 depict a different non-limiting example of a connector assembly 120 that provides an electrical and physical connection between low voltage bus line 6 and the power lead 122 that supplies electricity to light module 4. The same reference numerals from above are used to refer to similar features in this configuration even though the features are not identical structurally. Connector assembly 120 provides a protective housing for connector 20 and a physical connection between power lead 122 and low voltage bus line 6 so that connector 20 and the electrical connection between lead 122 and low voltage bus line 6 are protected from pulling forces which may be imparted to power lead 122. As described above, connector 20 may carry rectifier 22 and thus rectifier 22 also may be physically protected by connector assembly 120.

The configuration of connector assembly 120 depicted in FIGS. 18-20 is used to form an electrical connection between power lead 122 and low voltage bus line 6 by locating low voltage bus line 6 in a seat defined between the threaded legs 186 of the base of connector 20. This position aligns a pair of conductive elements of connector 20 with the conductors of low voltage bus line 6 so that they will pierce the insulation of low voltage bus line 6 when cover 188 is tightened down from an unclamped position onto the base of connector 20 into a clamped position wherein cover 188 is applying a clamping force to line 6. In this configuration cover 188 is in the form of the nut of connector 20 described above such that it performs two functions. Assembly 120 is configured to threadably clamp against line 6 to protect the electrical connection between connector 20 and line 6 from strain. Gaskets 190 are disposed between the bottom clamping surface of cover 188 and the top clamping surface of the base of connector 20 in order to seal the seat area around low voltage bus line 6. One or both of gaskets 190 may define a formed seat that complements the exterior shape of line 6. Gaskets 190 may be configured to complement or be conformable to the exterior shape of low voltage bus line 6 so that low voltage bus line 6 is clamped by connector assembly 120 and so that the area within the seat is sealed from the outside. The seal provided by gaskets 190 may be tight enough to make assembly 120 waterproof. Tabs 192 may project from leg 186 and cover 188 to hold one or both of the gaskets in place. Tab 192 may be disposed in a notch defined by gasket 190 to prevent rotation of gasket 192.

Gaskets 190 also may act as a locking device for cover or nut 188 to prevent it from backing off of legs 186. In a manner similar to FIGS. 13-14 described above, nut 188 and the base of connector 20 may be provided with locking fingers that prevent nut 188 from being unscrewed until a specially designed key is used to unlatch the locking fingers. These fingers may be disposed between legs 186 and nut 188 or between the lower surface of nut 188 and the upper surface of the base of connector 20.

Cover 188 and the base of connector 20 defines a plurality of ribs 194 that allow assembly 120 to be readily gripped when cover 188 is tightened. Ribs 194 also strengthen assembly 120 and provide protection to assembly 120 when it is dropped. Recesses 196 are defined by the top of nut 188 to reduce the weight of nut 188 and to provide tool openings.

In some configurations, power lead 122 may be directly connected to connector 20. In other configurations such as when connector assembly 120 carries rectifier 22 or a security signal receiver, an intermediate connector body 198 is desired. FIGS. 18-20 depict an exemplary configuration of such a body 198 which defines a cavity 200 that may hold the components discussed above. Body 198 may be threaded to connector 20, snap-fit to connector 20, or integrally formed with connector 20. The threaded connection depicted in FIG. 20 provides access to the components carried within cavity 200 so that the components may be replaced if needed. Power lead 122 is secured to body 198 with a wire clamp 136 to protect the electrical connections from strain and forces imparted on lead 122.

Both configurations of connector assembly 120 also may carry the components of the security signal system described above.

Advantages of lighting system 2 include that the operating temperature of the LED modules is never too hot to touch (in contrast to MH, quartz, halogen, etc), substantially reducing the possibility of injuries and fires. Additionally, the LED modules deliver superior quality and consistency in light output to conform to OSHA foot candle requirements. The LED modules are resistant to theft because they do not support standard input voltage.

An additional benefit is the energy savings. The following hypothetical example compares lighting system 2 to other lighting systems. On a 250,000 square foot job site with a two-year duration, approximately $700,000 in electricity savings alone is possible over the course of the project compared to a common existing lighting technology (factoring $0.18/KWh). System 2 consumes less than ⅓ the energy. The following is an analysis of the energy savings analysis for a hypothetical project using an LED-powered lighting system such as system 2 compared to existing incandescent, metal halide, and compact fluorescent lighting systems.

Description of exemplary project: Space to Illuminate (Sq Ft) 250,000; Ceiling Height (Ft) 15; Desired Illumination on Floor (Fc) 5; LED Modules per Kit (Lights) 12; Wire Length (Ft) 220; LED Modules Per 1000 Sq Ft 3; Kits Needed 73; LED Modules Needed 876; Light Module Spacing (Ft) 17; Light Module Coverage (Sq Ft) 289.

Assumptions for exemplary project: Power Cost Per Kilowatt Hour=$0.180 Dollars; Hours Per Month Illuminated=720 Hours; Duration of Project=24 Months.

Assumptions for lighting exemplary project with incandescent lights: Lights per 1000 Sq Ft=10 Lights; Unit Power=100 Watts; PS efficiency=100% Percent.

Assumptions for lighting exemplary project with metal halide lights: Lights per 1000 Sq Ft=1.11 Lights; Unit Power=400 Watts; PS efficiency=91% A Percent.

Assumptions for lighting exemplary project with compact fluorescent lights: Lights per 1000 Sq Ft=10 Lights; Unit Power=34 Watts; PS efficiency=71% Percent.

Assumptions for lighting exemplary project with system 2: Lights per 1000 Sq Ft (Average)=3.46 Lights; Unit Power=27 Watts; PS efficiency 86% Percent.

Power Cost for Project:

Incandescent $777,600 Dollars
Metal Halide $376,327 Dollars
Compact Fluorescent $341,055 Dollars
LED $82,818 Dollars Power Savings of System 2 compared to:

Incandescent $694,782 Dollars
Metal Halide $293,509 Dollars
Compact Fluorescent $258,237 Dollars Another advantage to system 2 is that all components of system 2 are RoHS (Restriction of the Use of Certain Hazardous Substances in Electrical and Electronic Equipment) compliant and contain no hazardous materials, unlike metal halide and compact fluorescent bulbs. The decrease in electricity consumption and reduction of electrical waste may offer opportunities for LEED (Leadership in Energy & Environmental Design) credits in addition to the benefits to the environment.

The illumination from an exemplary the LED module 4 is rated for L70 @ 50,000 hours. After almost 6 years of continuous use, the LEDs will shine at 70% of their initial brightness. The "lights" themselves are durable (impact-grade polycarbonate and aluminum assembly) and easily removable. In contrast to existing temporary lighting systems, they will last far more than a single project. In one example, each module 4 produces 2000 "focused" lumens directed at the target area, delivering approximately 8 fc at 15 ft spacing on center from 10 ft height.

System 2 may be provided with a low power feature that may be activated to reduce the amount of power consumed by system 2 while still causing the system to generate some light. Such a low power mode may be used when workers are not present. In one configuration, the low power mode reduces power consumption by 75 percent. The low power mode may be activated and deactivated with a button or switch on power supply 10. Other configurations allow the low power mode to be activated or deactivated remotely through a wireless connection, through a computer network connection such as an Internet connection, through a powerline network, or from a controller connected to each power supply 10 with a low voltage control line. These activation methods also may be used to turn system 2 on and off with no current supplied to low voltage bus line. Communication between power supply 10 and the controlling device (which may be a low power mode controller, computer or a timer) may be through a computer network such as the Internet or an intranet, through a telephone network, through a wireless communication channel, or through any other suitable communication channel. When a plurality of power supplies 10 are configured to respond to low power mode signals, the user may select which power supplies 10 remain at full power, which are turned off, and which are turn to low power such that system 2 may be customized.

Figure 21:
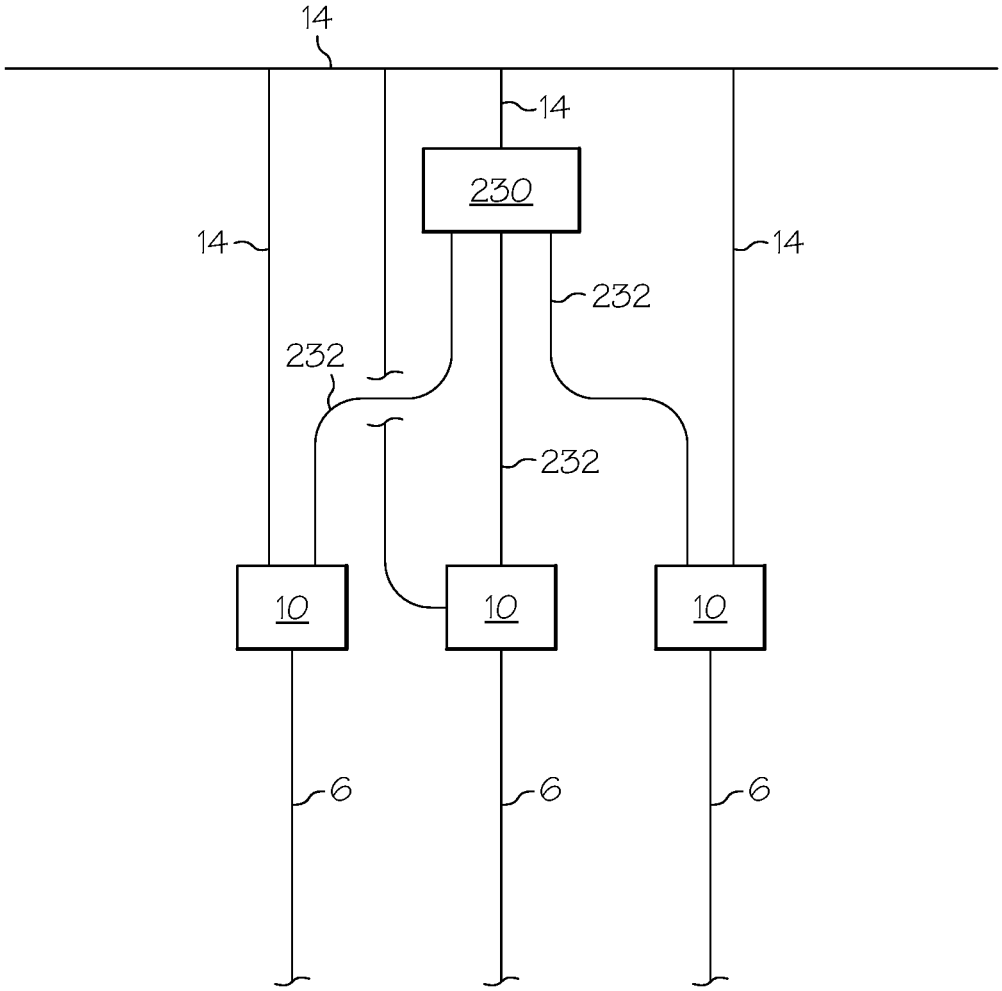
FIG. 21 is a schematic of a low power mode controller for the system.

In one configuration, a low power mode controller 230 (FIG. 21) is connected to each power supply 10 with a control line 232. Controller 230 may be connected to each supply 10 with its own line 232 or connected to all supplies 10 with a common line 232. Controller 230 selectively delivers a control signal to power supplies 10 to change the modes of the power supplies between a normal operating mode, a low power mode, or a shut down mode. The control signal may be any of a variety of signals transmitted via wire 232. For example, the control signal may be the presence of voltage in line 232. Further controller 230 may send different signals for different modes of power supplies 10. Power supplies 10 also may be configured to respond to the control signals in different manners to allow for customization. Controller 230 may have its own timer, may receive power mode control signals from a wired or wireless networks, or may be activated and deactivate with a manual switch.

Figure 15:
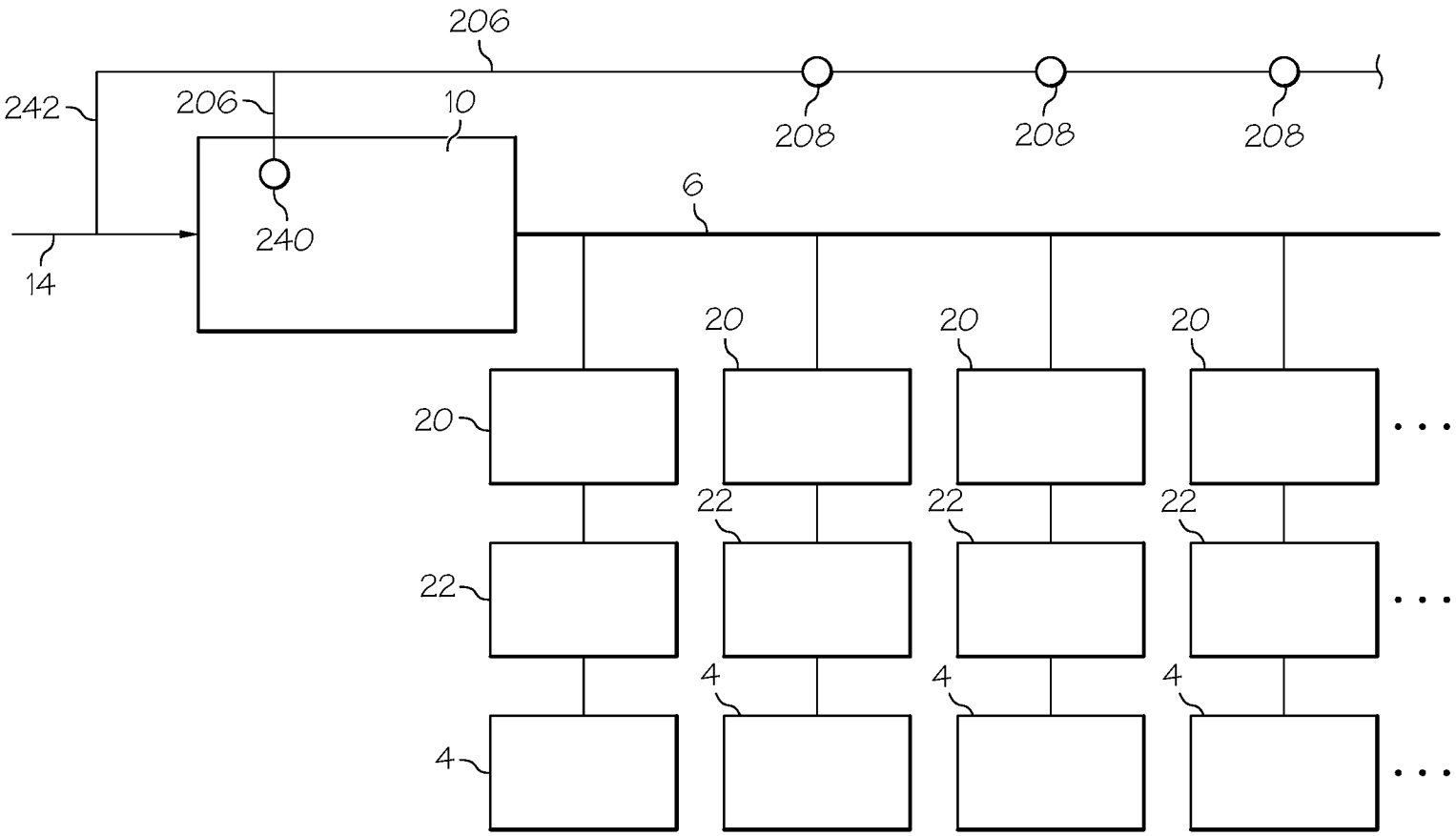
FIG. 15 is an electrical schematic of an alternative configuration of the system.

FIG. 15 depicts an alternative configuration of the system that provides a 110 Volt secondary power supply 206 in combination with low voltage bus line 6. The secondary power cord 206 carries a plurality of outlets 208 so that workers have ready access to standard power outlets 208 in a convenient location. Outlets 208 may be configured to accept any of a variety of known plugs to form a connection with the input power. Cord 206 may be connected to low voltage bus line 6 so that outlets are disposed along the same path as the task lighting. When cord 206 is used, it may be provided it a different color, shape, size and/or texture to help prevent the worker from applying connector 20 to cord 206. Cord 206 may be provided in a configuration that will not function with connector 20 such as a different cross sectional shape.

In one configuration, power supply 10 includes a socket 240 electrically connected to 110V alternating current power source 14 so that secondary power supply 206 may be plugged into outlet 240 of power supply 10 when supply line 206 is desired. An alternative configuration is identified by reference numeral 242 wherein supply 206 is connected to power source 14 upstream of power supply 10.

One exemplary configuration of secondary power supply 206 is two hundred and fifty feet long with outlets 208 disposed every forty to sixty feet from power supply 10.

Each outlet 208 may define a single socket or a plurality of sockets. Each outlet 208 or at least the initial, electrically upstream outlet may include a ground fault circuit interrupter (GFCI) for safety. Supply 206 is configured for use in wet conditions.

Figure 16:
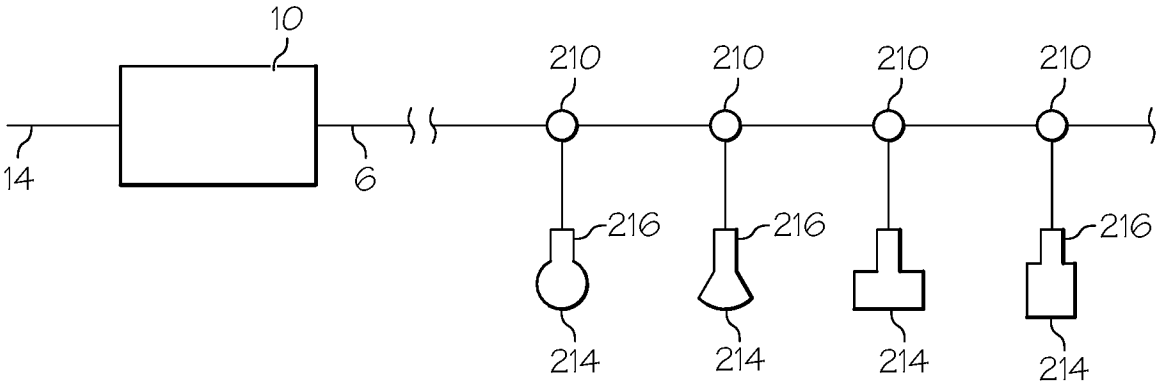
FIG. 16 is an electrical schematic of an alternative configuration of the system.

FIG. 16 depicts an alternative configuration wherein a plurality of sockets 210 are carried by low voltage bus line 6. Each socket 210 is configured to threadably receive a high output LED module 214 to provide the low voltage direct current to module 214. Either right hand or left hand threads may be used. As a security feature, LED module 214 may include a left hand thread 216 configured to be threadably received in a left hand threaded socket 210. Left hand threading reduces theft by reducing the usefulness of the threaded item. The connection between the threaded end of module 214 and socket 210 ensures the correct polarity of the connection and LED module 214 does not require rectifier 22 in this configuration. Further, line 6 is already provided with the correct power for module 4 such that module 4 does not require a transformer (or other type of drive that conditions the power). This configuration of system 2 thus allows lower-cost modules 4 to be produced and used with modules 4 having little value to a thief. LED module 214 is desirably the equivalent of at least a 60 Watt incandescent bulb or brighter. This configuration has the benefit that each module 214 does not require a driver, a transformer, or a rectifier. This feature reduces the value of modules 214 to a thief because modules 4 will not function when supplied with 110V line voltage. Using a left hand thread further reduces the value of modules 214 to a thief. Further, power supply 10 may be positioned in an inaccessible location to limit its vulnerability to theft. These features cooperate to reduce the theft value of the system. An example of the system depicted in FIG. 16 includes a stringer 6 that supports ten sockets 210 spaced eight to twelve feet apart. Each socket 210 is configured to removably receive a module 214 that does not include a driver or a transformer. Sockets 210 may be threaded left hand or right hand or may define a socket that receives a plug on module 214. Each module may be a 16 Watt LED PAR38 which is roughly equivalent to a 100 Watt incandescent bulb or a 12 Watt LED PAR38 which is roughly equivalent to a 75 Watt incandescent bulb. In this example, power supply 10 may be a two hundred and fifty Watt power supply.

Figure 17:
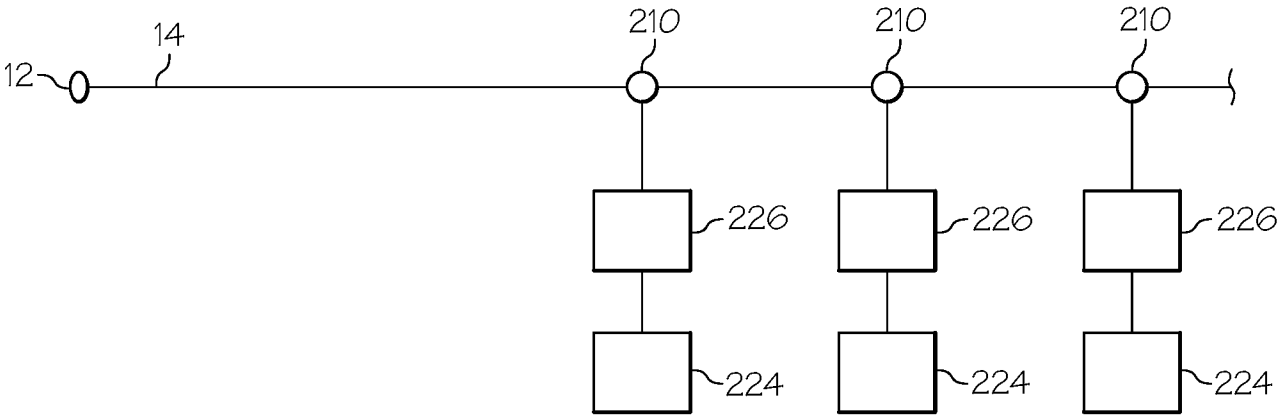
FIG. 17 is an electrical schematic of an alternative configuration of the system.

FIG. 17 depicts an alternative configuration of a task lighting system wherein a standard line voltage (for example: 110 V, 220 V or 450 V) alternating power source 14 (such as the cord depicted in FIGS. 16 and 17) supports a plurality of sockets 210. Power source 14 may be a cord having a plug configured to be connected to line voltage. Sockets 210 may be threaded with a right hand or a left hand thread. In this configuration, LED light modules 224 having their own AC to DC power transformers 226 are connected to sockets 210 to provide the task lighting. Transformers 226 may be configured to output 24V direct current. Sockets 210 are provided with a left hand thread and each LED light module 224 is provided with a left hand thread to reduce the locations where the light module 224 may be used.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the descriptions and illustrations are examples and the systems are not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. An LED task lighting system temporarily providing a plurality of LED light modules at a job site to temporarily provide task lighting to those working at the job site; the system comprising:

a direct current power supply having a plurality of low voltage direct current outputs;

a plurality of low voltage bus lines connected to the low voltage direct current outputs of the direct current power supply such that the low voltage bus lines are supplied with a low voltage direct current;

each low voltage bus line being temporarily strung up about the job site to be lit to provide temporary task lighting that provides light to workers at the job site prior to the installation of a permanent lighting system; each low voltage bus line being readily removable from the job site;

each of the low voltage bus lines having a plurality of threaded sockets electrically connected to the low voltage bus line;

a plurality of threaded LED light modules with each module having a threaded connector threadably engaged with one of the threaded sockets to provide an electrical connection between the module and the low voltage bus line;

the power supply may be placed into a low power mode wherein the voltage in the low voltage bus line is reduced; and the low power mode of the power supply being controlled by a timer carried by the power supply.

2. The system of claim 1, wherein the sockets are left hand threaded and the light modules are left hand threaded.

3. An LED task lighting system temporarily providing a plurality of LED light modules at a job site to temporarily provide task lighting to those working at the job site; the system comprising:

a direct current power supply having a plurality of low voltage direct current outputs;

a plurality of low voltage bus lines connected to the low voltage direct current outputs of the direct current power supply such that the low voltage bus lines are supplied with a low voltage direct current;

each low voltage bus line being temporarily strung up about the job site to be lit to provide temporary task lighting that provides light to workers at the job site prior to the installation of a permanent lighting system; each low voltage bus line being readily removable from the job site;

each of the low voltage bus lines having a plurality of threaded sockets electrically connected to the low voltage bus line;

a plurality of threaded LED light modules with each module having a threaded connector threadably engaged with one of the threaded sockets to provide an electrical connection between the module and the low voltage bus line;

the power supply may be placed into a low power mode wherein the voltage in the low voltage bus line is reduced; and the low power mode of the power supply being controlled through a network that is in communication with the power supply.

4. The system of claim 3, wherein the sockets are left hand threaded and the light modules are left hand threaded.

5. An LED task lighting system temporarily providing a plurality of LED light modules at a job site to temporarily provide task lighting to those working at the job site; the system comprising:

a direct current power supply having a low voltage direct current output;

a low voltage bus line connected to the low voltage direct current output of the direct current power supply such that the low voltage bus line is supplied with a low voltage direct current; the low voltage bus line being temporarily strung up about the job site to be lit to provide temporary task lighting to provide task lighting to workers at the job site prior to the installation of a permanent lighting system;

a plurality of threaded sockets electrically connected to the low voltage bus line; and a plurality of threaded LED light modules with each module having a threaded connector threadably engaged with one of the threaded sockets to provide an electrical connection between the module and the low voltage bus line;

wherein the power supply may be placed into a low power mode wherein the voltage in the low voltage bus line is reduced; and the low power mode of the power supply being controlled by a timer carried by the power supply.

6. The system of claim 5, wherein the sockets are left hand threaded and the light modules are left hand threaded.

7. The system of claim 5, wherein the light modules are free of rectifiers.

8. The system of claim 5, wherein the light modules are free of transformers.

9. The system of claim 5, wherein the power supply provides a direct current in the range of 20-30 Volts in the low voltage bus line.

10. The system of claim 5, further comprising a security signal receiver associated with each light module that allows the LED light module to be powered only after receiving a security signal.

11. The system of claim 5, further comprising a secondary power cord having a plurality of outlets; the secondary power cord adapted to carry a line voltage.

12. The system of claim 11, wherein one of the outlets carried by the secondary power cord is the first outlet; at least the first outlet including a ground fault circuit interrupter feature.

13. An LED task lighting system temporarily providing a plurality of LED light modules at a job site to temporarily provide task lighting to those working at the job site; the system comprising:

a direct current power supply having a low voltage direct current output;

a low voltage bus line connected to the low voltage direct current output of the direct current power supply such that the low voltage bus line is supplied with a low voltage direct current; the low voltage bus line being temporarily strung up about the job site to be lit to provide temporary task lighting to provide task lighting to workers at the job site prior to the installation of a permanent lighting system;

a plurality of threaded sockets electrically connected to the low voltage bus line; and a plurality of threaded LED light modules with each module having a threaded connector threadably engaged with one of the threaded sockets to provide an electrical connection between the module and the low voltage bus line;

wherein the power supply may be placed into a low power mode wherein the voltage in the low voltage bus line is reduced; and the low power mode of the power supply being controlled through a network that is in communication with the power supply.

14. The system of claim 13, wherein the sockets are left hand threaded and the light modules are left hand threaded.

15. The system of claim 13, wherein the light modules are free of rectifiers.

16. The system of claim 13, wherein the light modules are free of transformers.

17. The system of claim 13, wherein the power supply provides a direct current in the range of 20-30 Volts in the low voltage bus line.

18. The system of claim 13, further comprising a security signal receiver associated with each light module that allows the LED light module to be powered only after receiving a security signal.

19. The system of claim 13, further comprising a secondary power cord having a plurality of outlets; the secondary power cord adapted to carry a line voltage.

20. The system of claim 19, wherein one of the outlets carried by the secondary power cord is the first outlet; at least the first outlet including a ground fault circuit interrupter feature.

* * * * *